US007949283B2

(12) United States Patent
Okabe et al.

(10) Patent No.: US 7,949,283 B2
(45) Date of Patent: May 24, 2011

(54) PHOTOSENSITIVE MEMBER CARTRIDGE

(75) Inventors: Yasushi Okabe, Nagoya (JP); Shougo Sato, Seto (JP); Tsutomu Suzuki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 12/801,688

(22) Filed: Jun. 21, 2010

(65) Prior Publication Data

US 2010/0296836 A1 Nov. 25, 2010

Related U.S. Application Data

(60) Continuation of application No. 12/289,686, filed on Oct. 31, 2008, now Pat. No. 7,742,720, which is a continuation of application No. 11/802,215, filed on May 21, 2007, now Pat. No. 7,457,563, which is a continuation of application No. 11/269,666, filed on Nov. 9, 2005, now Pat. No. 7,245,850, which is a division of application No. 11/053,846, filed on Feb. 10, 2005, now Pat. No. 7,231,167, which is a division of application No. 10/733,390, filed on Dec. 12, 2003, now Pat. No. 6,873,810, which is a division of application No. 10/364,416, filed on Feb. 12, 2003, now Pat. No. 6,690,903, which is a division of application No. 10/153,643, filed on May 24, 2002, now Pat. No. 6,546,217, which is a division of application No. 09/928,514, filed on Aug. 14, 2001, now Pat. No. 6,411,789, which is a division of application No. 09/501,659, filed on Feb. 10, 2000, now Pat. No. 6,330,410, which is a continuation-in-part of application No. 09/281,948, filed on Mar. 31, 1999, now Pat. No. 6,041,203.

(30) Foreign Application Priority Data

Feb. 26, 1999 (JP) ..... 11-050232
Mar. 19, 1999 (JP) ..... 11-075560
Mar. 19, 1999 (JP) ..... 11-075561
Mar. 19, 1999 (JP) ..... 11-075562
Jun. 30, 1999 (JP) ..... 11-185126

(51) Int. Cl.
*G03G 21/18* (2006.01)

(52) U.S. Cl. ..... 399/113; 399/111

(58) Field of Classification Search ..... 399/113, 399/111, 110
See application file for complete search history.

(56) References Cited

U.S. PATENT DOCUMENTS 4,563,074 A 1/1986 Tsutsui et al. ..... 399/119
(Continued)

FOREIGN PATENT DOCUMENTS

CN 1195793 10/1998
(Continued)

OTHER PUBLICATIONS

Japanese Patent Office, Notice of Reasons for Rejection mailed Jan. 7, 2010 in Japanese Patent Application No. 2009-237037 w/English-language Translation.

(Continued)

*Primary Examiner* — Sophia S Chen
(74) *Attorney, Agent, or Firm* — Oliff & Berridge, PLC

(57) ABSTRACT

A photosensitive member cartridge for use with an image-forming apparatus includes a photosensitive drum and a cartridge case comprising an upper wall, a bottom wall, a right side wall, and a left side wall. An outer surface of the upper wall faces upwards when the photosensitive member cartridge is installed in the image-forming apparatus. The right side wall extends upwardly from a right side of the bottom wall, and the left side wall extends upwardly from a left side of the bottom wall. The upper wall connects upper edges of the right side wall and the left side wall. A light-entrance portion is formed in the upper wall and is configured to allow a laser beam to pass through the upper wall and reach the photosensitive drum when the photosensitive member cartridge is installed in the image-forming apparatus.

21 Claims, 31 Drawing Sheets

U.S. PATENT DOCUMENTS

| | | | | | |
|---|---|---|---|---|---|
| 4,657,372 | A | | 4/1987 | Ikeda et al. | 399/13 |
| 4,794,420 | A | | 12/1988 | Ohashi et al. | 399/75 |
| 4,806,977 | A | | 2/1989 | Mizutani et al. | 399/111 |
| 4,887,133 | A | | 12/1989 | Ikeda et al. | 399/124 |
| 4,888,620 | A | * | 12/1989 | Fujino et al. | 399/110 |
| 4,924,267 | A | | 5/1990 | Yoshikawa et al. | 399/112 |
| 4,987,446 | A | * | 1/1991 | Mochimaru et al. | 399/113 |
| 5,028,966 | A | | 7/1991 | Kozuka et al. | 399/113 |
| 5,111,244 | A | | 5/1992 | Koyama et al. | 399/111 |
| 5,160,964 | A | | 11/1992 | Takahashi et al. | 399/113 |
| 5,168,308 | A | | 12/1992 | Hiraike et al. | 399/125 |
| 5,206,682 | A | | 4/1993 | Yamada et al. | 399/111 |
| 5,208,634 | A | * | 5/1993 | Ikemoto et al. | 399/111 |
| 5,227,843 | A | | 7/1993 | Yamamoto et al. | 399/111 |
| 5,331,378 | A | | 7/1994 | Baker et al. | 399/111 |
| 5,343,223 | A | | 8/1994 | Tohyama et al. | 347/139 |
| 5,371,575 | A | | 12/1994 | Sekino et al. | 399/25 |
| 5,406,355 | A | | 4/1995 | Komuro et al. | 399/111 |
| 5,418,606 | A | | 5/1995 | Kikuchi et al. | 399/381 |
| 5,450,159 | A | | 9/1995 | Choi et al. | 399/113 |
| 5,463,446 | A | * | 10/1995 | Watanabe et al. | 399/111 |
| 5,530,528 | A | | 6/1996 | Houki et al. | 399/61 |
| 5,537,187 | A | | 7/1996 | Sekine | 399/113 |
| 5,552,857 | A | | 9/1996 | Ishikawa | 399/113 |
| 5,585,889 | A | | 12/1996 | Shishido et al. | 399/113 |
| 5,606,406 | A | | 2/1997 | Ikeyama et al. | 399/111 |
| 5,666,596 | A | | 9/1997 | Yoo | 399/111 |
| 5,740,491 | A | | 4/1998 | Imai | 399/25 |
| 5,745,824 | A | | 4/1998 | Yashiro | 399/113 |
| 5,805,959 | A | | 9/1998 | Hazama et al. | 399/111 |
| 5,835,822 | A | | 11/1998 | Nagasaki et al. | 399/111 |
| 5,842,091 | A | | 11/1998 | Nakano | 399/258 |
| 5,842,093 | A | | 11/1998 | Tanda | |
| 5,845,176 | A | | 12/1998 | Yoshida et al. | 399/113 |
| 5,893,006 | A | | 4/1999 | Kanno et al. | 399/13 |
| 5,899,601 | A | | 5/1999 | Yamaguchi et al. | 399/110 |
| 5,920,752 | A | | 7/1999 | Karakama et al. | 399/111 |
| 5,953,561 | A | | 9/1999 | Tashiro et al. | 399/111 |
| 5,966,566 | A | | 10/1999 | Odagawa et al. | 399/109 |
| 6,011,935 | A | | 1/2000 | Matsuzaka et al. | 399/12 |
| 6,041,203 | A | | 3/2000 | Suzuki et al. | 399/111 |
| D422,304 | S | | 4/2000 | Suzuki et al. | D18/43 |
| D423,559 | S | | 4/2000 | Suzuki et al. | D18/40 |
| 6,101,350 | A | | 8/2000 | Suzuki et al. | 399/113 |
| 6,141,519 | A | | 10/2000 | Sato | 399/252 |
| 6,173,140 | B1 | | 1/2001 | Suzuki et al. | 399/113 |
| 6,195,522 | B1 | | 2/2001 | Sato | 399/284 |
| 6,219,505 | B1 | | 4/2001 | Sato et al. | 399/98 |
| D442,216 | S | | 5/2001 | Kimura et al. | D18/43 |
| D447,511 | S | | 9/2001 | Kimura et al. | D18/40 |
| 6,304,735 | B1 | | 10/2001 | Nishimura et al. | 399/98 |
| 6,321,050 | B1 | | 11/2001 | Sato et al. | 399/103 |
| 6,330,410 | B1 | | 12/2001 | Okabe et al. | 399/113 |
| 6,336,014 | B1 | | 1/2002 | Sato et al. | 399/103 |
| 6,337,956 | B1 | | 1/2002 | Sato et al. | 399/27 |
| 6,356,723 | B1 | | 3/2002 | Sato et al. | 399/103 |
| 6,385,414 | B1 | | 5/2002 | Sato et al. | 399/98 |
| 6,411,789 | B1 | | 6/2002 | Okabe et al. | 399/113 |
| 6,456,810 | B1 | | 9/2002 | Deguchi et al. | 399/254 |
| 2002/0025187 | A1 | | 2/2002 | Sato et al. | 399/111 |
| 2002/0028086 | A1 | | 3/2002 | Sato et al. | 399/103 |
| 2002/0090226 | A1 | | 7/2002 | Sato et al. | 399/103 |

FOREIGN PATENT DOCUMENTS

| | | | |
|---|---|---|---|
| EP | A-63-273878 | | 11/1988 |
| EP | 0 368 346 | A2 | 11/1989 |
| EP | 0 368 346 | A3 | 11/1989 |
| EP | 0 437 097 | A2 | 7/1991 |
| EP | A2-0 501 497 | | 9/1992 |
| EP | A2-0 530 491 | | 3/1993 |
| EP | A-5-216304 | | 8/1993 |
| EP | 0 590 939 | A2 | 4/1994 |
| EP | A-7-175399 | | 7/1995 |
| EP | A-8-54786 | | 2/1996 |
| EP | A-9-43921 | | 2/1997 |
| EP | 0 795 794 | A1 | 3/1997 |
| EP | 0 810 490 | A1 | 6/1997 |
| EP | A-9-244484 | | 9/1997 |
| EP | A1-0 810 490 | | 12/1997 |
| EP | A-9-319285 | | 12/1997 |
| EP | A2-0 866 387 | | 9/1998 |
| JP | 59-7387 | | 1/1984 |
| JP | A-61-63871 | | 4/1986 |
| JP | A-62-16953 | | 1/1987 |
| JP | U-64-17539 | | 1/1989 |
| JP | U-2-67364 | | 5/1990 |
| JP | 2-158756 | | 6/1990 |
| JP | A-2-213859 | | 8/1990 |
| JP | A-2-281268 | | 11/1990 |
| JP | A-3-41476 | | 2/1991 |
| JP | A-03-107169 | | 5/1991 |
| JP | 4-110862 | | 4/1992 |
| JP | 4-190251 | | 7/1992 |
| JP | U 4-93849 | | 8/1992 |
| JP | U-4-93849 | | 8/1992 |
| JP | A-4-267277 | | 9/1992 |
| JP | 4-322260 | | 11/1992 |
| JP | A-5-35005 | | 2/1993 |
| JP | A-05-074431 | | 3/1993 |
| JP | 5-197302 | | 8/1993 |
| JP | 5-273804 | | 10/1993 |
| JP | 05-297646 | A * | 11/1993 |
| JP | A-06-003891 | | 1/1994 |
| JP | A-06-043706 | | 2/1994 |
| JP | A-6-175425 | | 6/1994 |
| JP | A-6-186798 | | 7/1994 |
| JP | A-06-222629 | | 8/1994 |
| JP | 06-250450 | | 9/1994 |
| JP | A-06-242643 | | 9/1994 |
| JP | B2-6-95234 | | 11/1994 |
| JP | A-6-332345 | | 12/1994 |
| JP | A-06-348123 | | 12/1994 |
| JP | A-07-028374 | | 1/1995 |
| JP | 7-69473 | | 3/1995 |
| JP | A-7-84500 | | 3/1995 |
| JP | 7-121086 | | 5/1995 |
| JP | A-7 234552 | | 9/1995 |
| JP | A-7-271274 | | 10/1995 |
| JP | 7-295457 | | 11/1995 |
| JP | 07-311535 | | 11/1995 |
| JP | 7-311536 | | 11/1995 |
| JP | A-8-194428 | | 7/1996 |
| JP | A-8-227238 | | 9/1996 |
| JP | A-09-050224 | | 2/1997 |
| JP | 09 062099 | | 3/1997 |
| JP | 09-197746 | A * | 7/1997 |
| JP | A-9-212063 | | 8/1997 |
| JP | A-9-311610 | | 12/1997 |
| JP | A-10-254327 | | 9/1998 |
| JP | A-11-79474 | | 3/1999 |
| JP | A-11-84796 | | 3/1999 |

OTHER PUBLICATIONS

Japanese Patent Office, Notice of Reasons for Rejection mailed Jan. 7, 2010 in Japanese Patent Application No. 2009-237038 w/English-language Translation.

Japanese Patent Office, Notice of Reasons for Rejection mailed Oct. 22, 2008 in Japanese Patent Application No. 11-050232 w/English-language Translation.

Japanese Patent Office, Notice of Reasons for Rejection mailed Nov. 26, 2008 in Japanese Patent Application No. 2006-244586 w/English-language Translation.

Japanese Patent Office, Notice of Reasons for Rejection mailed Nov. 26, 2008 in Japanese Patent Application No. 2006-244585 w/English-language Translation.

Japanese Patent Office, Final Notice of Reasons for Rejection mailed Jan. 19, 2011 in Japanese Patent Application No. HEI 11-050232 w/Partial English-language Translation.

* cited by examiner 700
710
710b
300c
300d
12a

PHOTOSENSITIVE MEMBER CARTRIDGE

This is a Continuation Application of application Ser. No. 12/289,686, filed Oct. 31, 2008, which in turn is a Continuation Application of application Ser. No. 11/802,215, filed May 21, 2007, now U.S. Pat. No. 7,457,563, issued Nov. 25, 2008, which in turn is a Continuation Application of application Ser. No. 11/269,666, filed Nov. 9, 2005, now U.S. Pat. No. 7,245,850, issued Jul. 17, 2007, which in turn is a Divisional Application of application Ser. No. 11/053,846, filed Feb. 10, 2005, now U.S. Pat. No. 7,231,167, issued Jun. 12, 2007, which in turn is a Divisional of application Ser. No. 10/733,390, filed Dec. 12, 2003, now U.S. Pat. No. 6,873,810, issued Mar. 29, 2005, which in turn is a Divisional Application of application Ser. No. 10/364,416, filed Feb. 12, 2003, now U.S. Pat. No. 6,690,903, issued Feb. 10, 2004, which is in turn a Divisional of application Ser. No. 10/153,643, filed May 24, 2002, now U.S. Pat. No. 6,546,217, issued Apr. 8, 2003, which is a Divisional of application Ser. No. 09/928,514, filed Aug. 14, 2001, now U.S. Pat. No. 6,411,789, issued Jun. 25, 2002, which is a Divisional of application Ser. No. 09/501,659, filed Feb. 10, 2000, now U.S. Pat. No. 6,330,410, issued Dec. 11, 2001, which is a Continuation-in-Part of application Ser. No. 09/281,948, filed Mar. 31, 1999, now U.S. Pat. No. 6,041,203, issued Mar. 31, 1999, the entire disclosures of which are hereby incorporated herein by reference.

BACKGROUND OF THE INVENTION

1. Field of Invention

The invention relates to a photosensitive member cartridge and a process cartridge for use in an electrostatographic image forming apparatus.

2. Description of Related Art

Some electrostatographic image forming apparatus in which a visible image is obtained by supplying toner to an electrostatic latent image formed on a photosensitive drum, are disclosed in, for example, Japanese Patent Publication Nos. 8-54786 and 9-319285, which correspond to U.S. Pat. Nos. 5,845,176 and 5,805,959, respectively.

The former publication discloses such structures that a photosensitive member cartridge including a photosensitive drum, and a developer cartridge including a developing roller, are separately set in a housing.

The latter publication discloses such structures that a photosensitive member cartridge and a developer cartridge are movably connected at one portion by a pin, so that a photosensitive member and a developing roller press against each other.

Generally, the surface of the photosensitive drum is coated with a light-sensitive material. To prevent the surface of the photosensitive drum from being scratched or contaminated, some measures need to be taken. Otherwise, when a portion of the photosensitive surface is scratched or contaminated with, for example, dust, such as would be caused by touching the surface of the photosensitive drum by hand, the photosensitive characteristics of the photosensitive surface are changed. Consequently, the image quality is adversely affected.

Accordingly, a well-known structure, in which the photosensitive drum is covered with a shutter, is employed for apparatus, such as those disclosed in the above-described publications.

However, the shutter needs to be constructed so as to open when the photosensitive member cartridge is set in a body (housing), and so as to close when the photosensitive member cartridge is removed from the body (housing). This makes the structure of the photosensitive member cartridge complicated. In addition, the possibility arises that a user may accidentally open the shutter and touch the surface of the photosensitive member cartridge.

Further, when the photosensitive member cartridge is placed on a table, the shutter may accidentally open, so that the photosensitive drum may be exposed.

SUMMARY OF THE INVENTION

One aspect of the invention is to provide a photosensitive member cartridge that obviates the danger of contamination or scratches on a photosensitive member. To achieve this aspect, the photosensitive member cartridge of the invention includes a case, and a photosensitive member and a transfer roller which are rotatably disposed in the case. The case covers the photosensitive member and the transfer roller. Specially, a bottom wall of the case covers a lower portion of the transfer roller, and upper and rear walls cover the photosensitive member.

The bottom wall extends below the transfer roller. On the extending portion of the bottom wall, a developer cartridge, including a developing roller, is set. Such structures prevent the photosensitive member and the transfer roller from being accidentally touched, which enhances image quality.

Also, it is unnecessary to provide complicated components such as a shutter, so that the structures of the photosensitive member cartridge are simplified.

Further, foot portions provided on the underside of the bottom wall stabilize the photosensitive member cartridge when it is placed on a table.

BRIEF DESCRIPTION OF THE DRAWINGS

A preferred embodiment of the invention will be described in detail with reference to the following figures wherein:

FIG. 11(*b*) is a sectional view taken on line XIb-XIb in FIG. 11(*a*);

FIG. 12(*b*) is a right side view of the developer cartridge;

FIG. 20(*b*) illustrates a situation in which the process unit is further inserted;

DETAILED DESCRIPTION OF PREFERRED EMBODIMENTS

Figure 1:
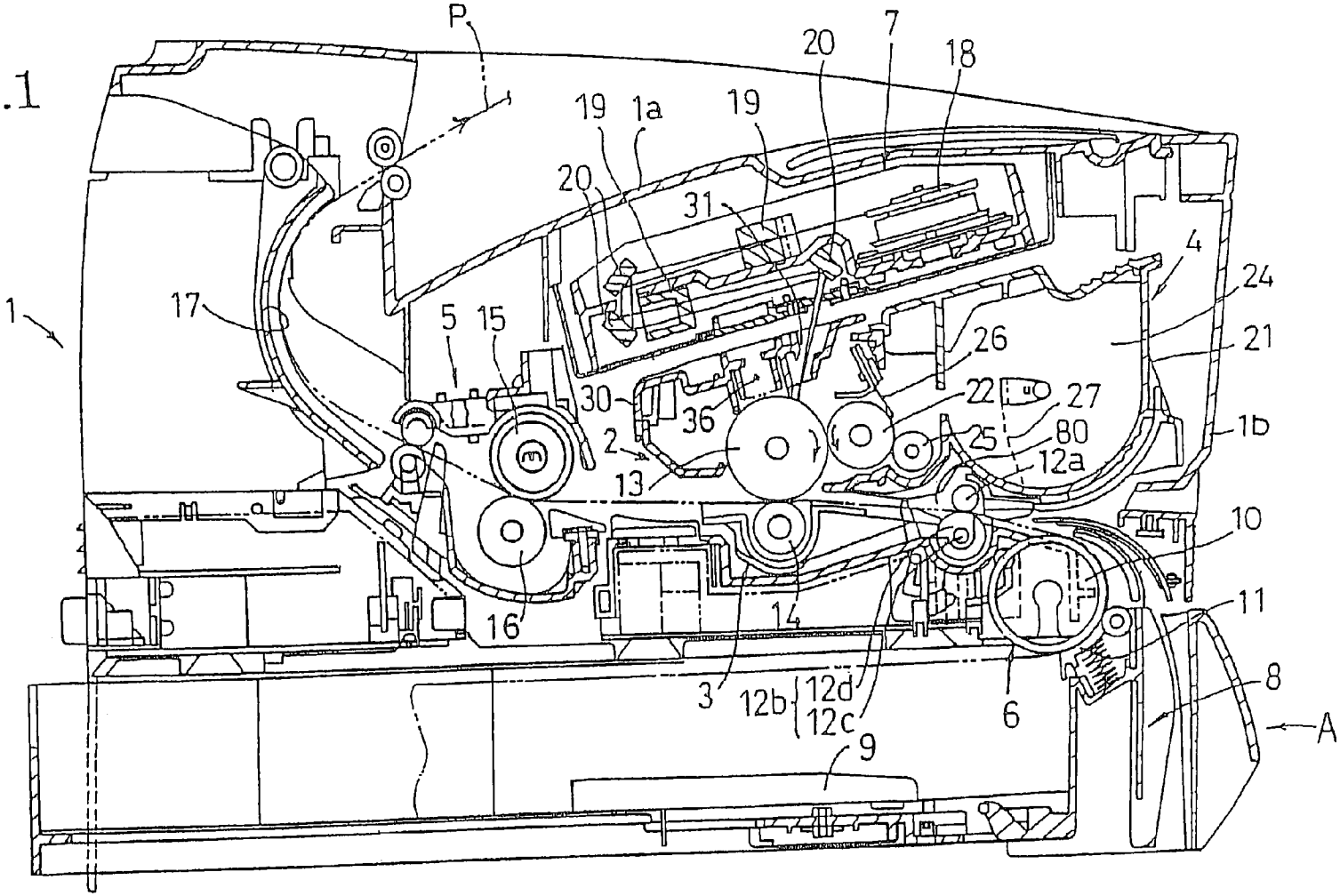
FIG. 1 is a schematic side sectional view of a printer embodying the image forming apparatus of the invention.
Figure 2:
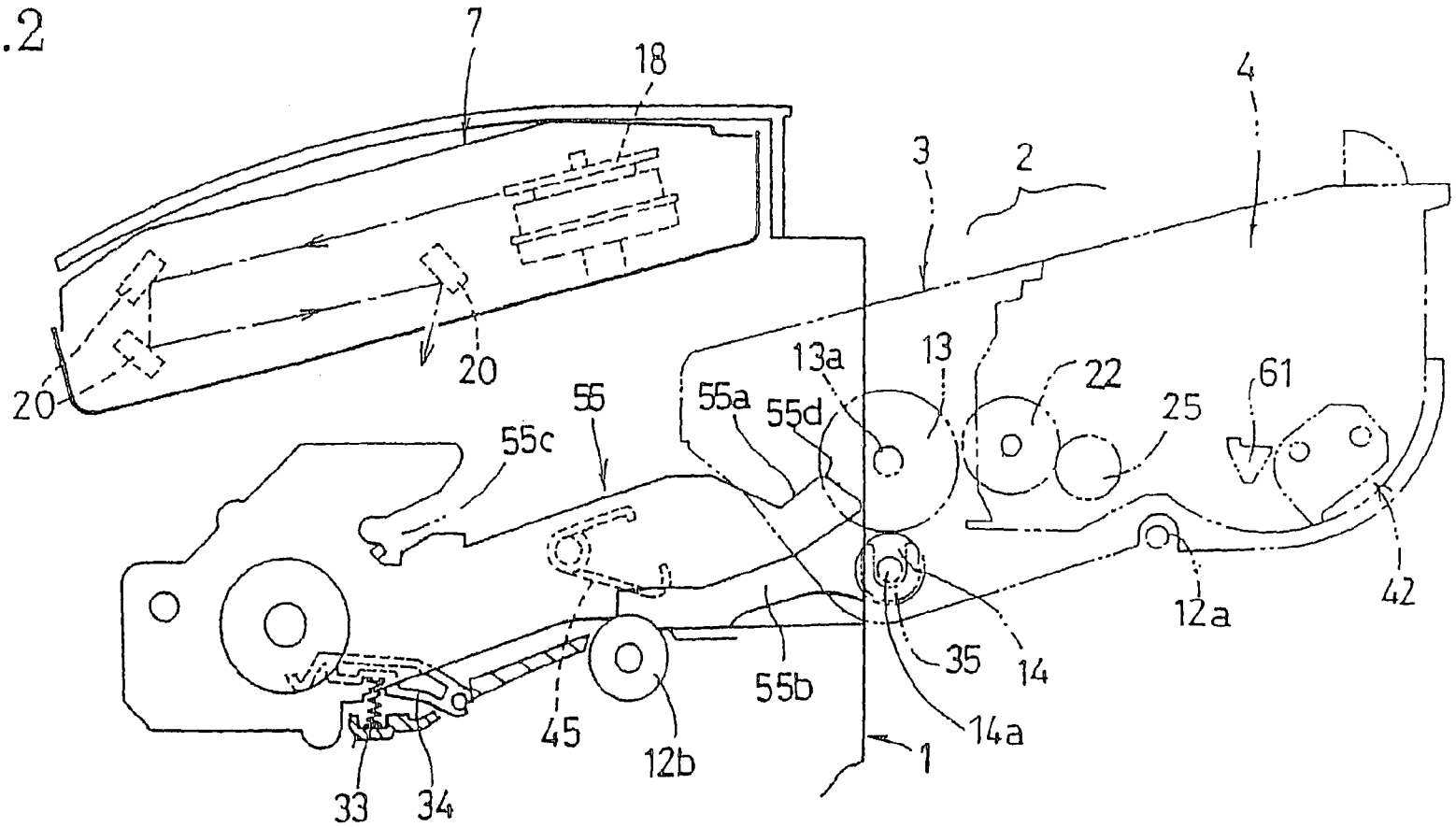
FIG. 2 is a side view of the printer, illustrating a situation where the insertion of a process unit into a body housing is started.

A preferred embodiment in which the invention is embodied in a laser beam-type printer will be described in detail hereinafter with reference to the accompanying drawings. FIG. 1 is a schematic side sectional view of a printer embodying the image forming apparatus of the invention. FIG. 2 is a partly cut-away side view of the printer, illustrating a situation where the insertion of a process unit 2 into a body housing 1 is started.

Referring to FIG. 1, the process unit 2 having a photosensitive member cartridge 3 and a developer cartridge 4 is removably disposed in a substantially central portion of the body housing 1 of the printer. As shown in a left portion of FIG. 1, a fixer 5 is disposed adjacent to the process unit 2. A sheet feeder 6 is disposed below the process unit 2. A sheet cassette 8 is attachable to a lower portion of the body housing 1 by moving the sheet cassette 8 from a front face of the body housing 1 (as indicated by arrow A).

A laser scanning unit 7 is mounted to a lower surface of a synthetic resin-made discharge sheet tray 1*a*, via a frame. The discharge sheet tray 1*a* also serves as a cover.

When print data is transmitted to the printer from an external apparatus, for example, a personal computer, upon a print instruction, a sheet P (recording medium) is separated from a stack of sheets P on a support plate 9 of the sheet cassette 8 by a separator pad 11, in a manner of one sheet at a time, as a sheet feed roller 10 of the sheet feeder 6 rotates. The separated sheet P is conveyed to a contact portion between a photosensitive drum 13 (photosensitive member) in the process unit 2 and a transfer roller 14 (transfer device) pressed against a lower face of the photosensitive drum 13, via a pair of register rollers 12*a*, 12*b*.

A laser beam is emitted from the laser scanning unit 7 having a laser light-emitting portion, a polygon mirror 18, a lens 19, a plurality of reflecting mirrors 20 and the like, through a light-emitting hole formed in a lower portion of the frame supporting the laser scanning unit 7. The laser beam travels to an upper peripheral surface portion of the photosensitive drum 13, via a light entrance portion 31 formed in a case 30 of the photosensitive member cartridge 3, that is, a case of the process unit 2. The peripheral surface of the photosensitive drum 13 is thereby exposed corresponding to the print data, so as to form an electrostatic latent image.

Developer (toner) supplied from a developing roller 22 of the developer cartridge 4 becomes deposited on the electrostatic latent image on the photosensitive drum 13, thereby making the image visible. After the visible image formed by developer (toner) is transferred from the photosensitive drum 13 to the sheet P, the sheet P is conveyed between a heat roller 15 and a presser roller 16 in the fixer 5, in which the sheet P is subjected to a heat-fixing process. The sheet P is then discharged onto the discharge sheet tray 1*a* via a sheet discharge passage 17.

In this embodiment, the process unit 2 includes the photosensitive member cartridge 3 having at least the photosensitive drum 13, and the developer cartridge 4 having at least the developing roller 22 (developing device) that is disposed in a case 21. The developer cartridge 4 is designed so that the developer cartridge 4 is detachably attachable to the photosensitive member cartridge 3, and so that the developing roller 22 is prevented from detaching by a lock device 46 described later.

The structures of the photosensitive member cartridge 3 and the developer cartridge 4 will be described in detail. As shown in FIGS. 3 through 7, the synthetic resin-made case 30 in the photosensitive member cartridge 3 is integrally formed with a bottom wall 30*a*, a pair of side walls 30*c* extending upwardly from the right and left sides of the bottom wall 30*a*, an upper wall 30*b* connecting the upper edges of the pair of side walls 30*c*, and a rear wall 30*e* connected to one side of the upper wall 30*b*, an end of each of the right and left side walls 30*c*, and one side of the bottom wall 30*a*. The photosensitive drum 13 is set in the case 30 near one side thereof, that is, in an area that is surrounded with the upper wall 30*b*, the rear wall 30*e*, the right and left side walls 30*c*, and the bottom wall 30*a*. The photosensitive drum 13 is rotatably journaled in the right and left side walls 30*c*. The right and left side walls 30*c* and the bottom wall 30*a* extend forward of the photosensitive drum 13.

Figure 4:
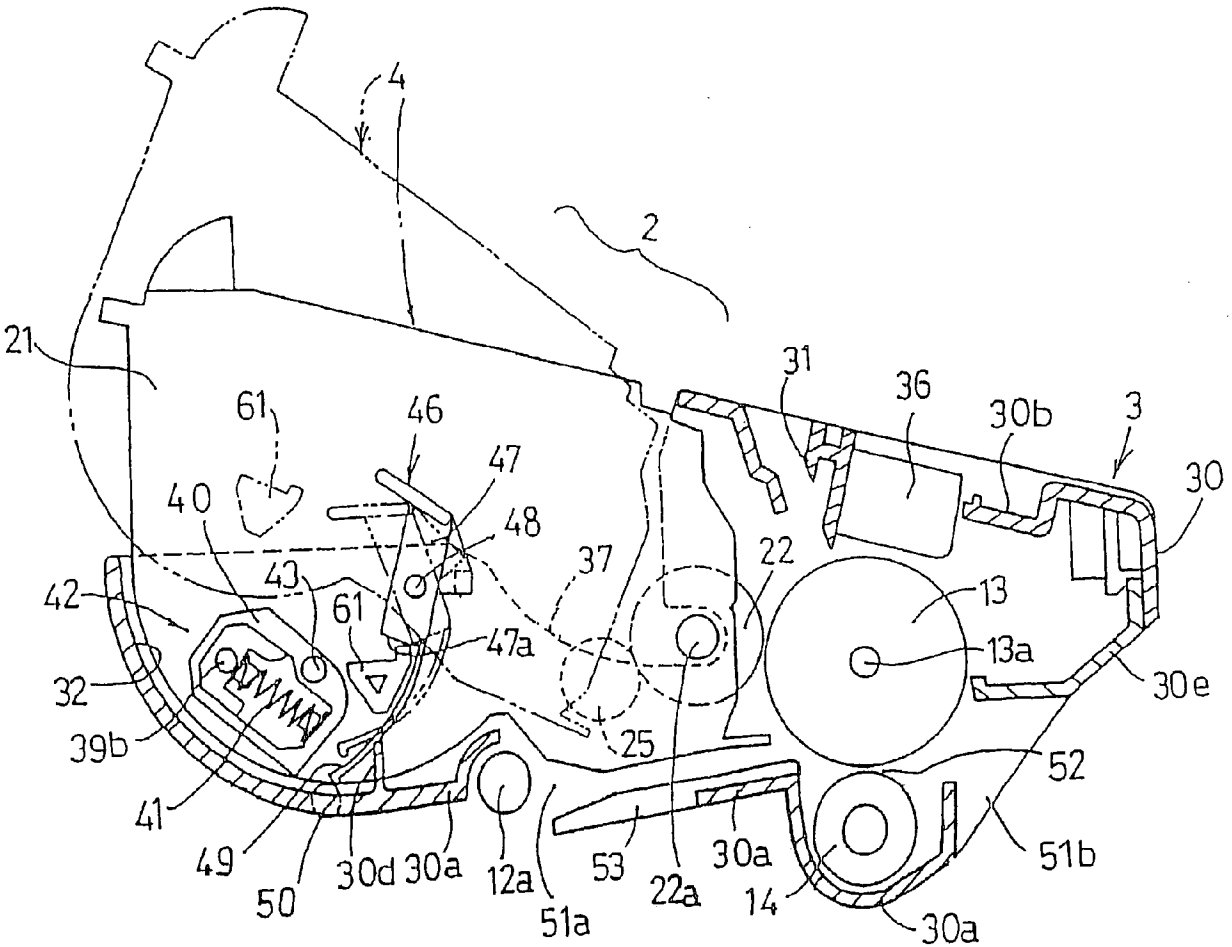
FIG. 4 is a side sectional view of the photosensitive member cartridge taken on plane IV-IV in FIG. 3.
Figure 8:
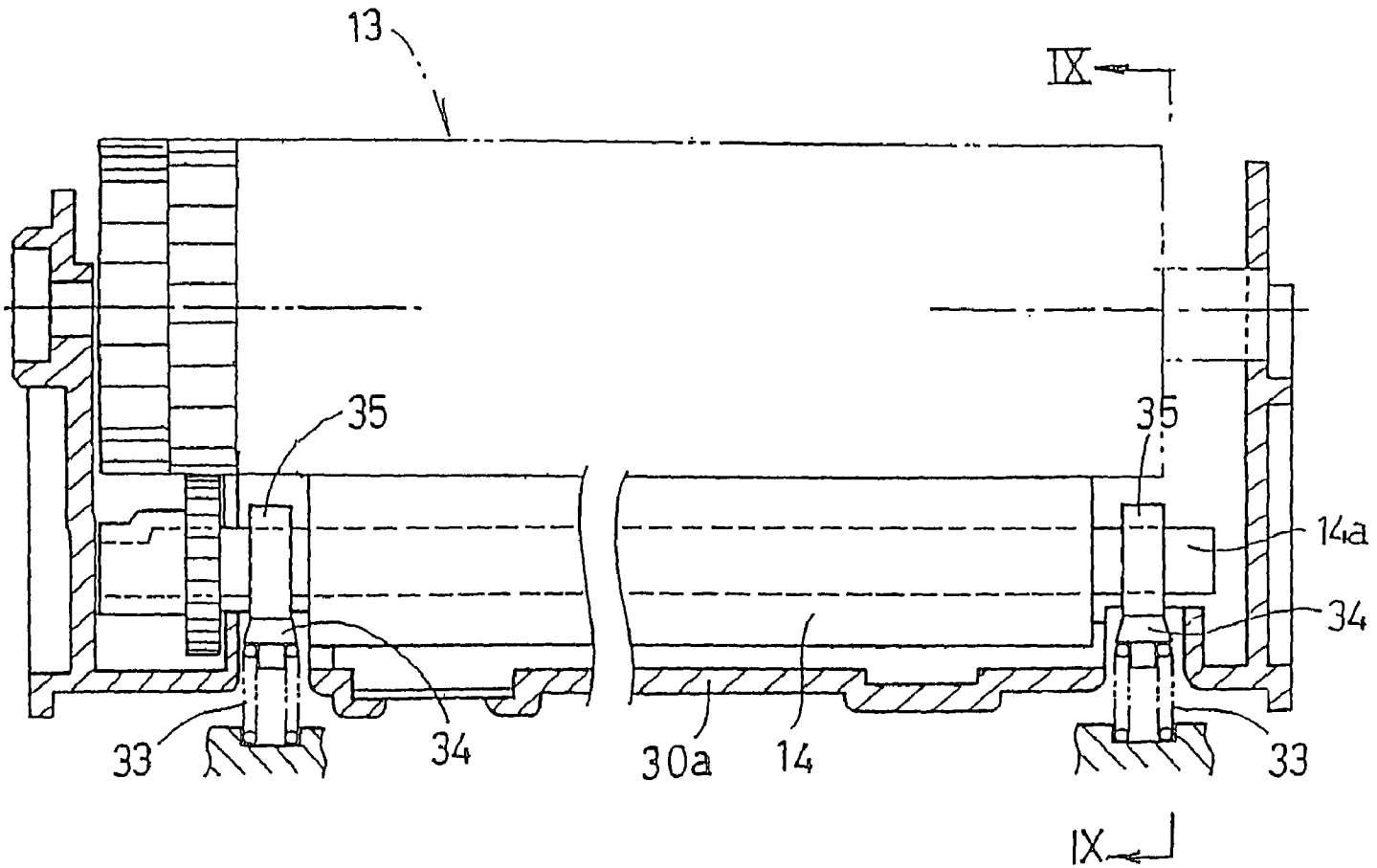
FIG. 8 is a partially cut-away sectional view illustrating a pressing portion of a transfer roller.

As shown in FIG. 4, a lower portion of the transfer roller 14 disposed below the photosensitive drum 13 is covered with the bottom wall 30*a* of the case 30. The transfer roller 14 is vertically movably journaled in such a manner that the transfer roller 14 can separate from a lower surface of the photosensitive drum 13 due to the weight of the transfer roller 14. When the process unit 2 is set into the body housing 1, the transfer roller 14 contacts the lower surface of the photosensitive drum 13. More specifically, upwardly open "U"-shaped bearings 35 fitted to both end portions of the shaft 14*a* of the transfer roller 14 are raised by shaft bearing raisers 34 (see FIGS. 8 and 9) that are urged upward by springs 33 disposed at the right and left side inner faces of the body housing 1, so that the transfer roller 14 is moved upward to press the lower surface (transfer region) of the photosensitive drum 13. On the other hand, when the process unit 2 is removed from the body housing 1, the transfer roller 14 separates from the photosensitive drum 13 without receiving the action of the springs 33.

The upper wall 30*b* of the case 30 covers an upper portion of the photosensitive drum 13. The light entrance portion 31, allowing irradiation of an upper surface of the photosensitive drum 13 with laser light emitted from the laser scanning unit 7, is formed in the upper wall 30*b*, and is elongated in the directions of an axis of the photosensitive drum 13. Disposed adjacent to the light entrance portion 31 is a charger 36, such as a scorotron or the like, that charges a photosensitive surface of the photosensitive drum 13. An electrostatic latent image is formed on the surface of the photosensitive drum 13 by scanning laser light over the surface of the photosensitive drum 13 uniformly charged by the charger 36. After the electrostatic latent image is made visible (developed) by deposition thereon of a thin layer of toner supplied via the developing roller 22, the toner image is transferred to the sheet P fed in between the photosensitive drum 13 and the transfer roller 14, which press against, and contact with, each other.

A portion of the case 30, other than the upper wall 30*b*, is open upward. The portion is defined by the right and left side walls 30*c*, and the bottom wall 30*a* having a curved surface with a substantially quarter of a circle. The upwardly open portion is an accommodating portion 32 into which the developer cartridge 4 can be set at an angle from above.

With the above-described structures, almost all of the outer surfaces of the photosensitive drum 13 are covered with the rigidly and integrally formed case 30, so that stability, when an operator handles the photosensitive drum 13 by hand, is increased.

Since the bottom wall 30*a* of the case 30 extends toward the direction away from the photosensitive drum 13, the circumference of the photosensitive drum 13 is not touched, even when the operator holds the extending portion of the bottom wall 30*a*. Therefore, when the operator handles the photosensitive member cartridge 3 by hand, the photosensitive surface of the photosensitive drum 13 remains untouched, so that the surface of the photosensitive drum 13 will not be contaminated and instead will always be kept clean.

In particular, when the developer cartridge 4 is connected to the photosensitive member cartridge 3, the bearings 23*a*, 23*b* contact and move along a first section of the guide grooves 37 in a direction that includes a vertical component. The bearings 23*a*, 23*b* then contact and move along a second section of the guide grooves 37 in a direction that is substantially horizontal. The difference of direction of movement of the bearings 23*a*, 23*b* is due to the arcuate shape of the guide grooves 37. Also, because of this arcuate shape, the bearings 23*a*, 23*b* move faster along the first section of the guide grooves then along the second section.

Figure 10:
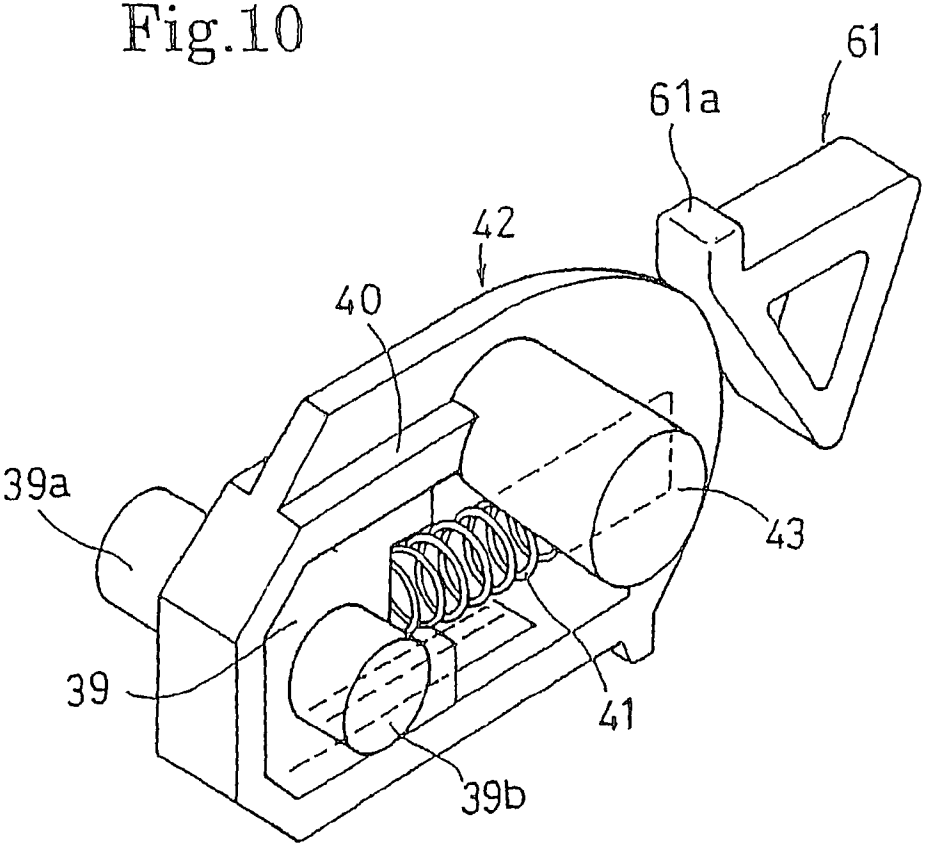
FIG. 10 is a perspective view of an urging device and an action-receiving portion.

An urging device 42 that presses the developing roller 22 against the photosensitive drum 13 via the developer cartridge 4 is pivotably and expandably mounted to an inner surface of each of the right and left side walls 30*c*. As shown in FIGS. 4 and 10, each urging device 42 has a pivot fulcrum member 39 provided with pivots 39*a*, 39*b* protruding integrally from the right and left sides thereof, a frame-like slide support member 40 that connects with and supports the pivot fulcrum member 39 that facilitates sliding movements therein, and an urging spring device 41, such as a coil spring or the like, that is disposed in the frame of the slide support member 40 so as to urge the pivot fulcrum member 39 toward one end. The slide support member 40 has a cylindrical motion acting portion 43 extending laterally. The motion acting portion 43 of each urging device 42 is disposed so that the portion 43 protrudes outward from a guide hole 44 formed in the corresponding one of the right and left side walls 30*c*.

Figure 5:
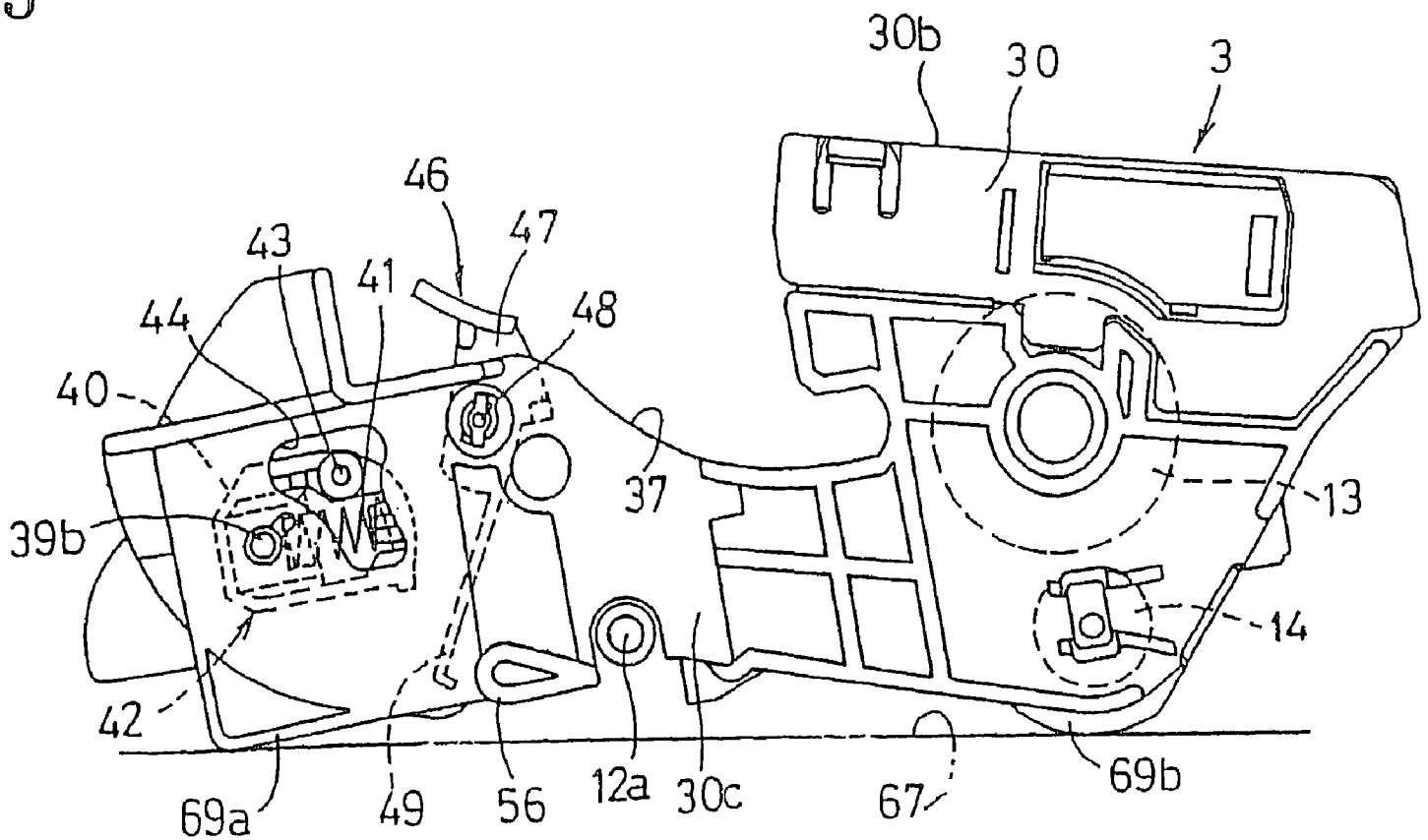
FIG. 5 is a right side view of the photosensitive member cartridge.
Figure 6:
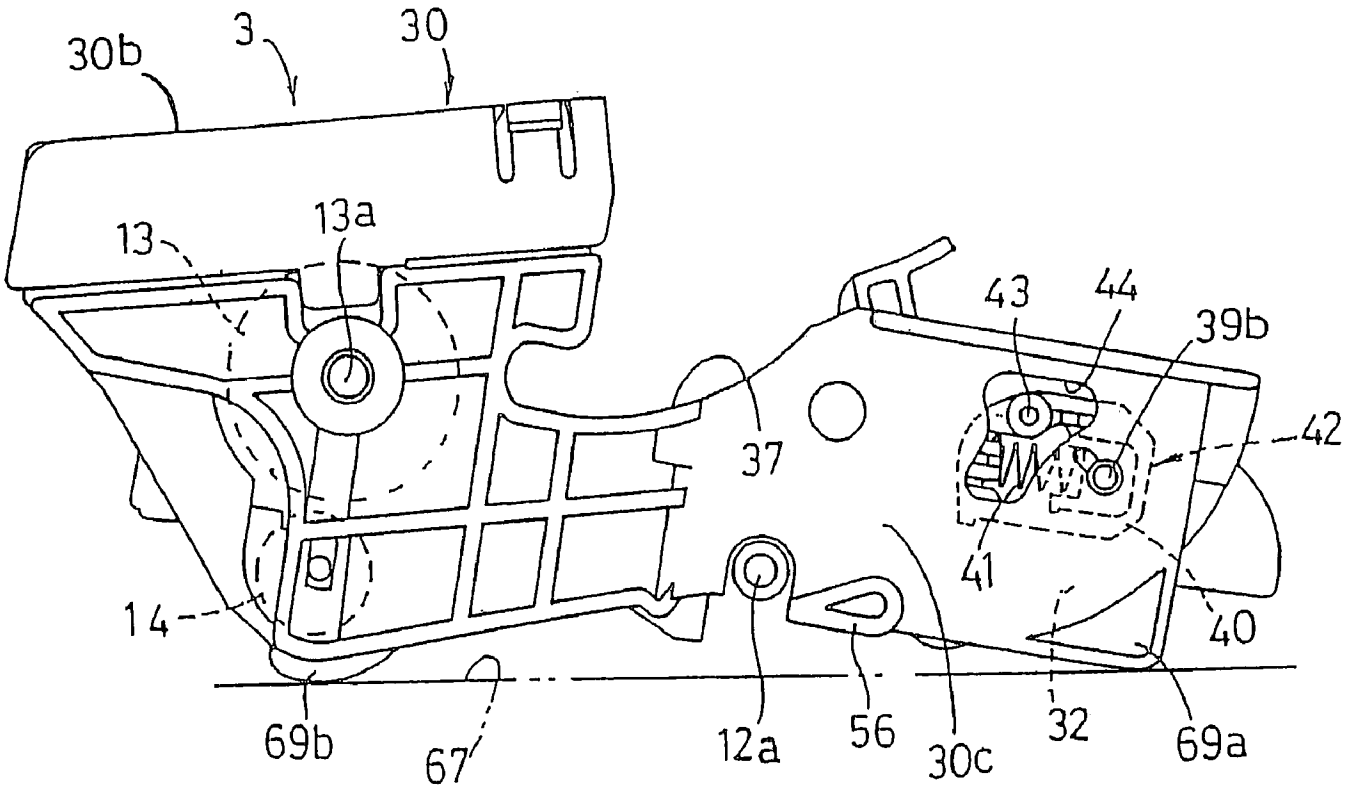
FIG. 6 is a left side view of the photosensitive member cartridge.
Figure 11A:
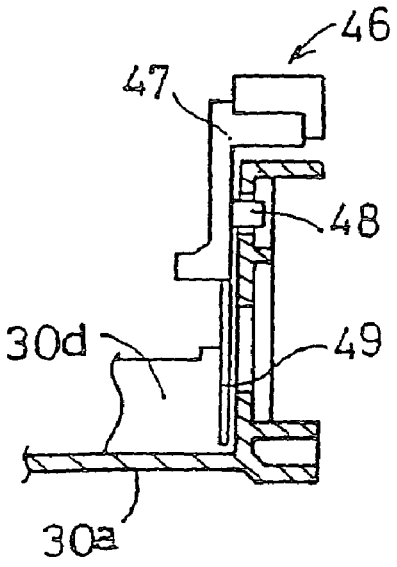
FIG. 11(*a*) is a plan view of a lock device.
Figure 11B:
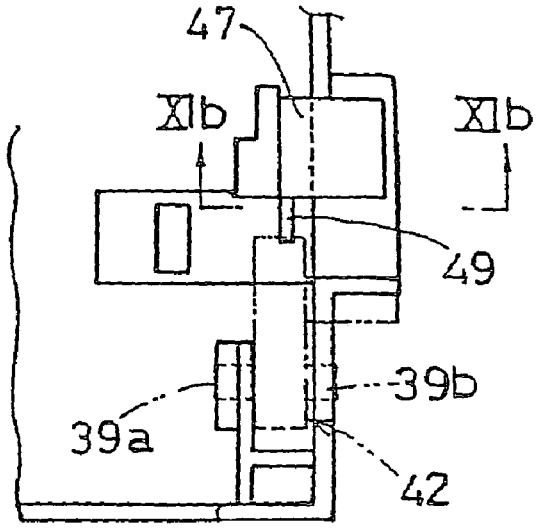

The lock device 46 that prevents the developer cartridge 4, which is fitted into the accommodating portion 32, from moving upward out of the accommodating portion 32, is disposed at an inner side of one of the right and left side walls 30*c* (the right side wall in the embodiment) of the photosensitive member cartridge 3. As shown in FIGS. 4, 5, 11(*a*) and 11(*b*), the lock device 46 is designed so that a rotating shaft 48 extending through the side wall 30*c* axially supports a lock lever 47 in such a manner that the lock lever 47 is pivotable relative to a side surface of the lock lever 47.

A resin-made spring 49 extending downward from a lower end of the lock lever 47 is disposed so that a lower portion of the resin-made spring 49 contacts a restriction piece 30*d* protruding upward from the bottom wall 30*a* of the case 30. A lower surface of the lock lever 47 has an arched contact portion 47*a* that restricts upward motion of one of action-receiving portions 61 (right-side one) protruding outward from the right and left side surfaces of the case 21 of the developer cartridge 4, by contacting an upper surface of the action-receiving portion 61. The action-receiving portions 61 have a generally inverted triangular shape in side view.

The action-receiving portions 61 are disposed so that they communicate with the lock device 46 and, furthermore, urging devices 42 that press the developing roller 22 against the photosensitive drum 13.

Figure 3:
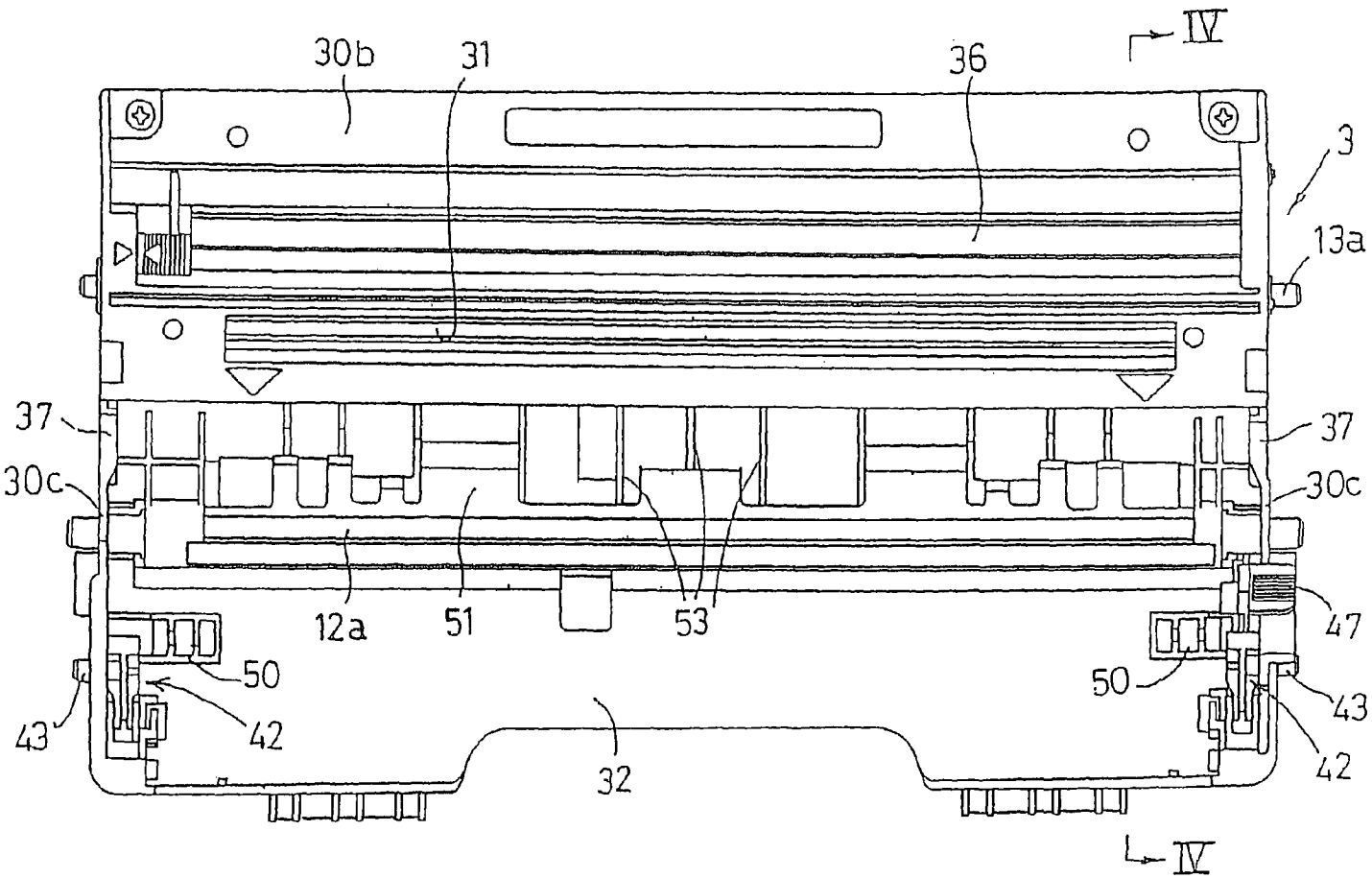
FIG. 3 is a plan view of a photosensitive member cartridge.
Figure 12A:
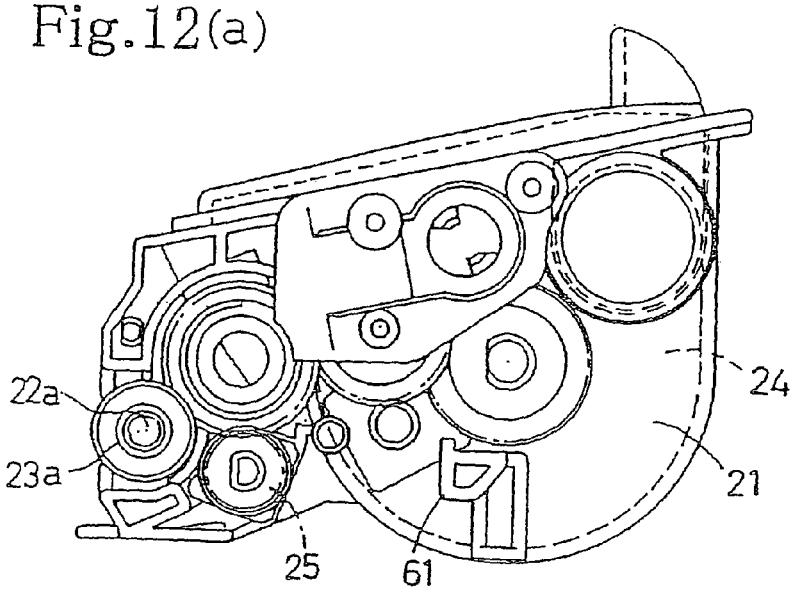
FIG. 12(*a*) is a left side view of a developer cartridge.
Figure 12B:
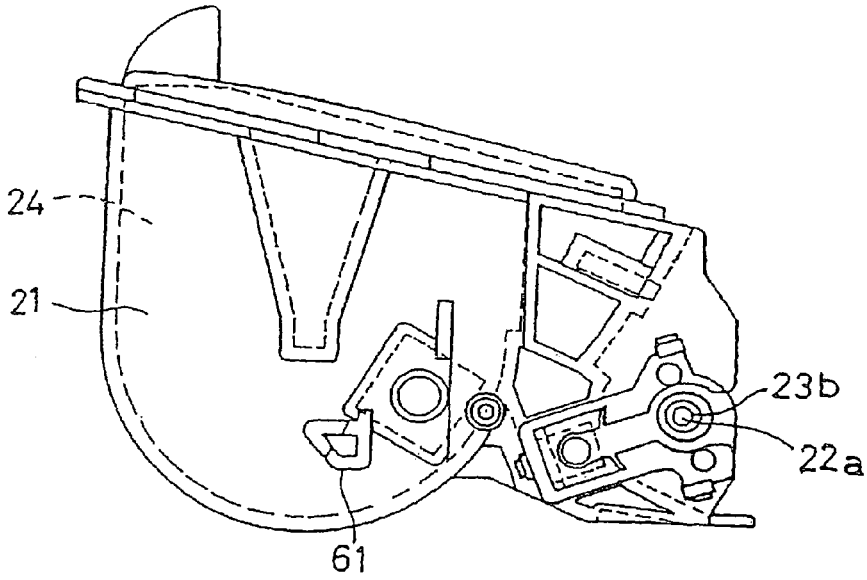
Figure 13:
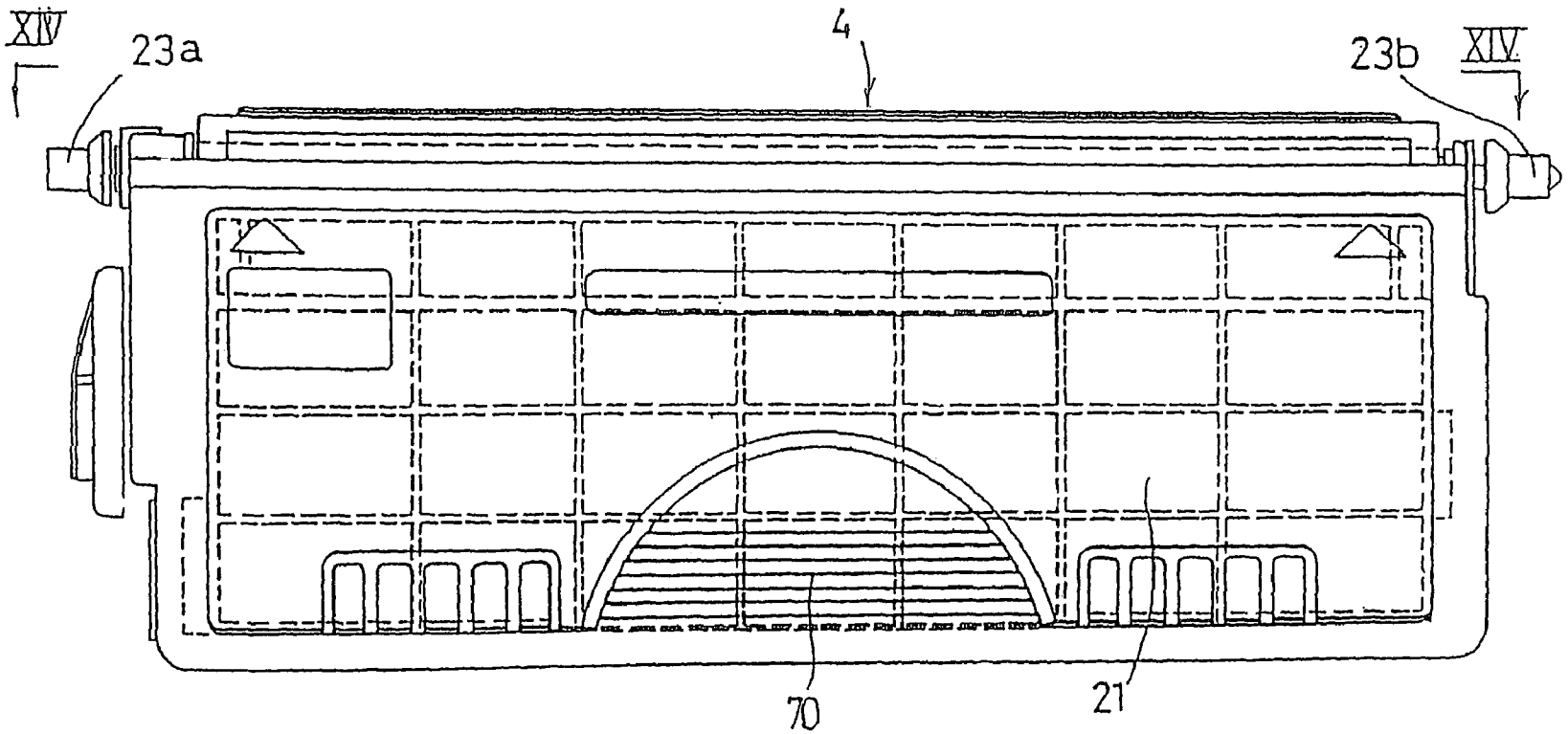
FIG. 13 is a plan view of the developer cartridge.
Figure 14:
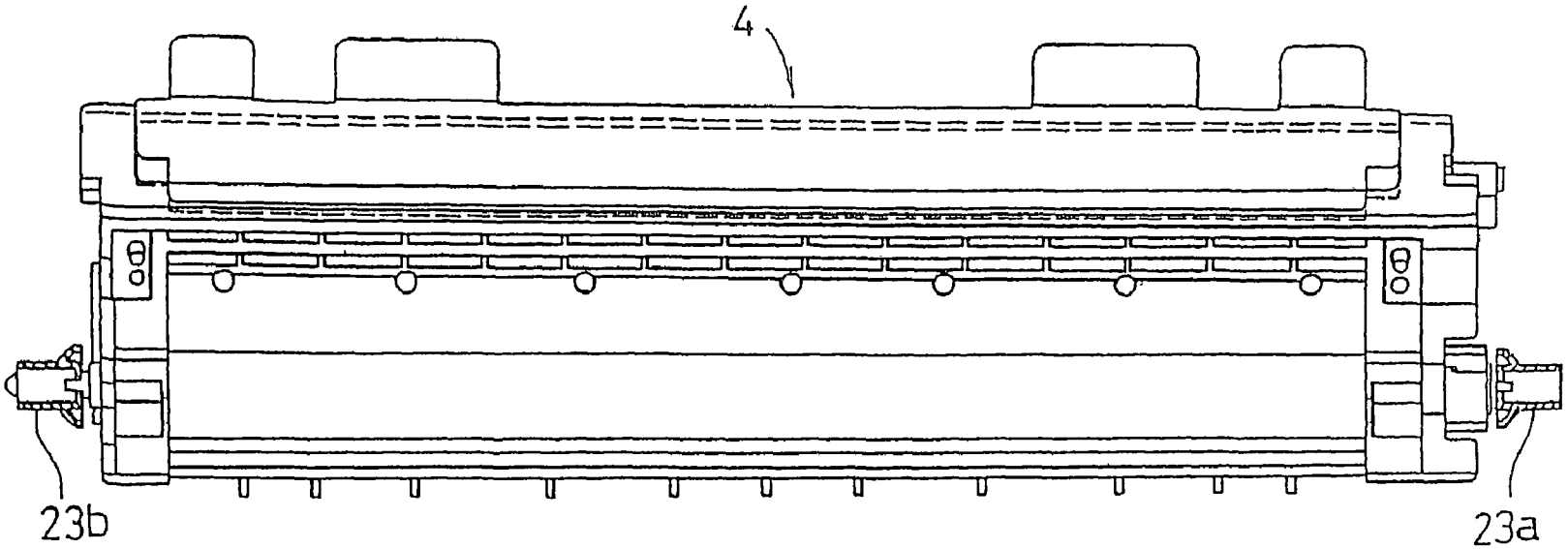
FIG. 14 is a view of the developer cartridge taken in the direction indicated by arrows XIV in FIG. 13.

Rollers 50 are disposed, as receiving members, at a plurality of positions (two positions in the embodiment, that is, at right and left end portions) in the bottom wall 30*a* of the case 30, in the accommodating portion 32 of the photosensitive member cartridge 3 (see FIGS. 3 and 4). The rollers 50 protrude from the inner surface of the bottom wall 30*a*. When the developer cartridge 4 is inserted down into the accommodating portion 32, the rollers 50 (receiving device) receive a portion of the weight of the developer cartridge 4, at a side across the developing roller shaft 22*a* of the developing roller 22 from the photosensitive drum 13, that is, a side of the developing roller shaft 22*a* of the developing roller 22 opposite from the photosensitive drum 13. More specifically, the rollers 50 contact lower portions of a downward-convex curved surface of a toner containing chamber 24 (see FIGS. 1, 12(*a*) and 12(*b*)) formed in the case 21 of the developer cartridge 4, and the rollers 50 reduce the rattling of the case 21 during the setting or removing operation.

The upper roller 12*a* of the pair of register rollers is mounted to the bottom wall 30*a* of the case 30 of the photosensitive member cartridge 3 in such a manner that the upper roller 12*a* is prevented from detaching. The bottom wall 30*a* has a laterally elongated introduction hole 51 adjacent to the upper roller 12*a*, to introduce the sheet P from the pair of register rollers 12*a*, 12*b* into a transfer portion 52 between the photosensitive drum 13 and the transfer roller 14. The upper surface of a portion of the bottom wall 30*a* extending between the introduction hole 51 and the transfer portion 52 has many ribs 53 extending in a direction from the introduction hole 51 to the transfer portion 52. The ribs 53 are designed so that the sheet P can be smoothly conveyed with a reduced contact resistance on the lower surface of the sheet P.

A discharge hole 51*b* is formed between the bottom wall 30*a* and the rear wall 30*e* of the case 30, to convey the sheet P between a heat roller 15 and a presser roller 16, through the transfer portion 52 (see FIG. 4).

The structure of the developer cartridge 4 will be described with reference to FIGS. 1, 12*a*, 12*b* and 13 through 15. After toner in the downward-convex toner containing chamber 24 in the case 21 is stirred by a rotationally driven stirrer 27 and discharged therefrom, toner is carried onto the outer peripheral surface of the developing roller 22 via a supply roller 25. A blade 26 is provided for restricting the layer thickness of toner on the developing roller 22 (see FIG. 1). The generally inverted triangular-shaped action-receiving portions 61 protrude from the right and left side outer ends of the toner containing chamber 24 in the case 21.

The shaft bearings 23*a*, 23*b* rotatably fitted to the right and left end portions of the developing roller shaft 22*a* are formed from a material whose friction coefficient is small, such as an acetal resin or the like. Each of the bearings 23*a*, 23*b* has an engaging nail 62 that engages with an annular groove 63 so that the bearing will not detach from the shaft end. Each of the shaft bearings 23*a*, 23*b* has, at its base end side, an umbrella-shaped (conical) shaft diameter adjusting portion 64 whose diameter gradually increases.

Figure 15:
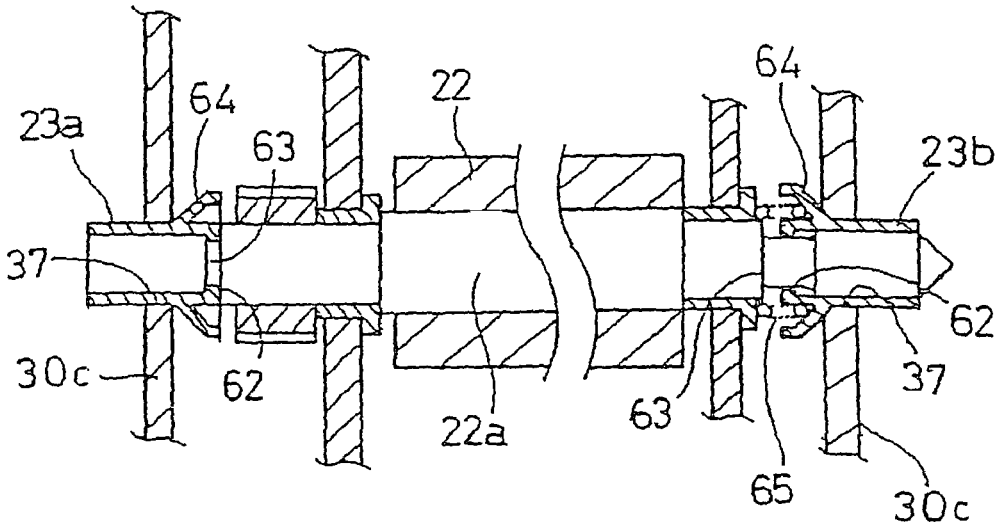
FIG. 15 is a sectional view of the developer cartridge, illustrating the structure of shaft bearings disposed at the right and left sides of the developer cartridge.

At least one of the shaft bearings 23*a*, 23*b* (the right-side bearing 23*b* in the embodiment) is slidingly urged laterally outward by a spring device 65 (see FIG. 15). Therefore, when the developer cartridge 4 is set at a predetermined position with respect to the photosensitive member cartridge 3, the developing roller shaft 22*a* of the developing roller 22 are supported, without rattling, on the guide grooves 37 formed in the right and left side walls 30*c* of the photosensitive member cartridge 3.

Figure 16:
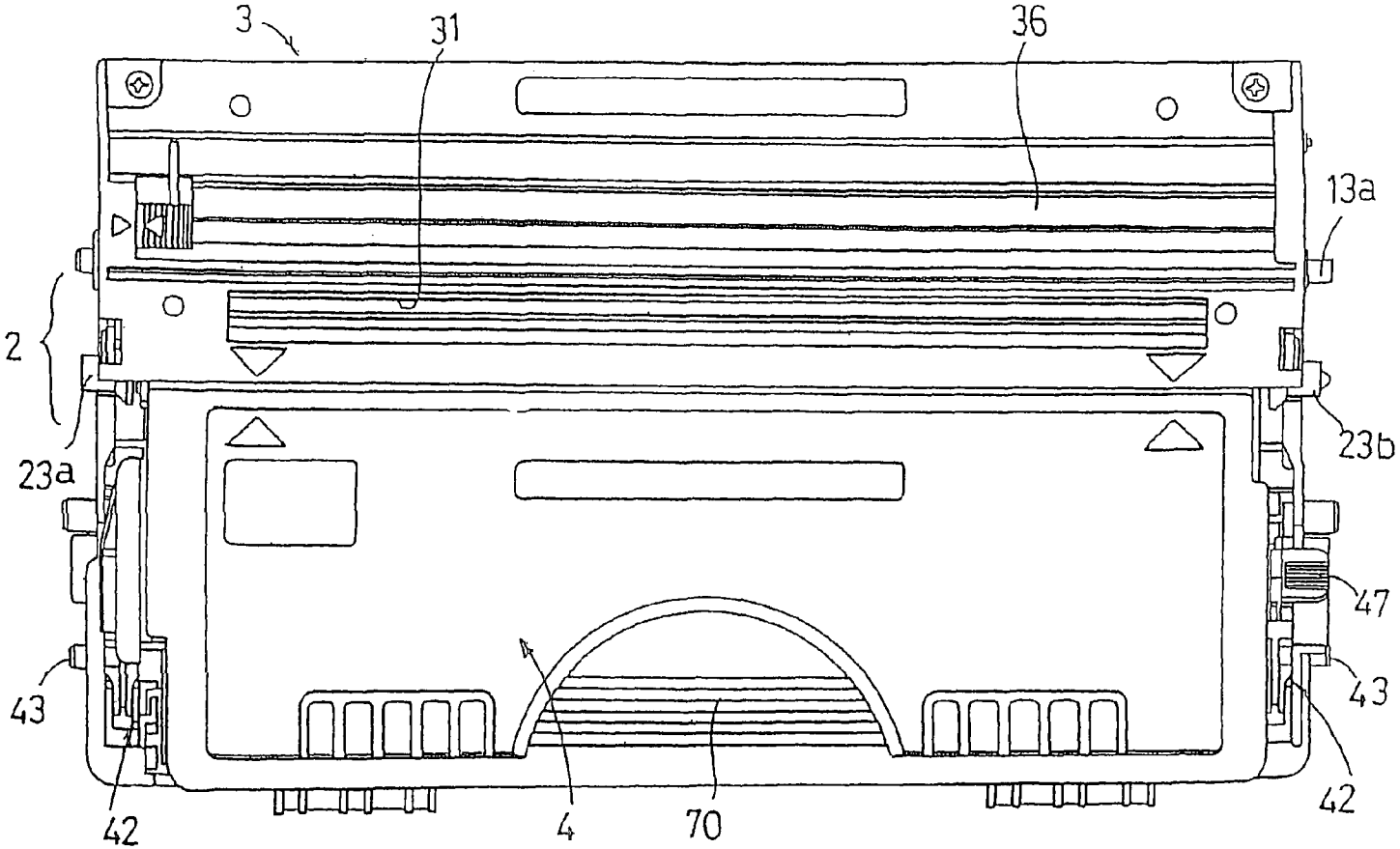
FIG. 16 is a plan view of a process unit.
Figure 19:
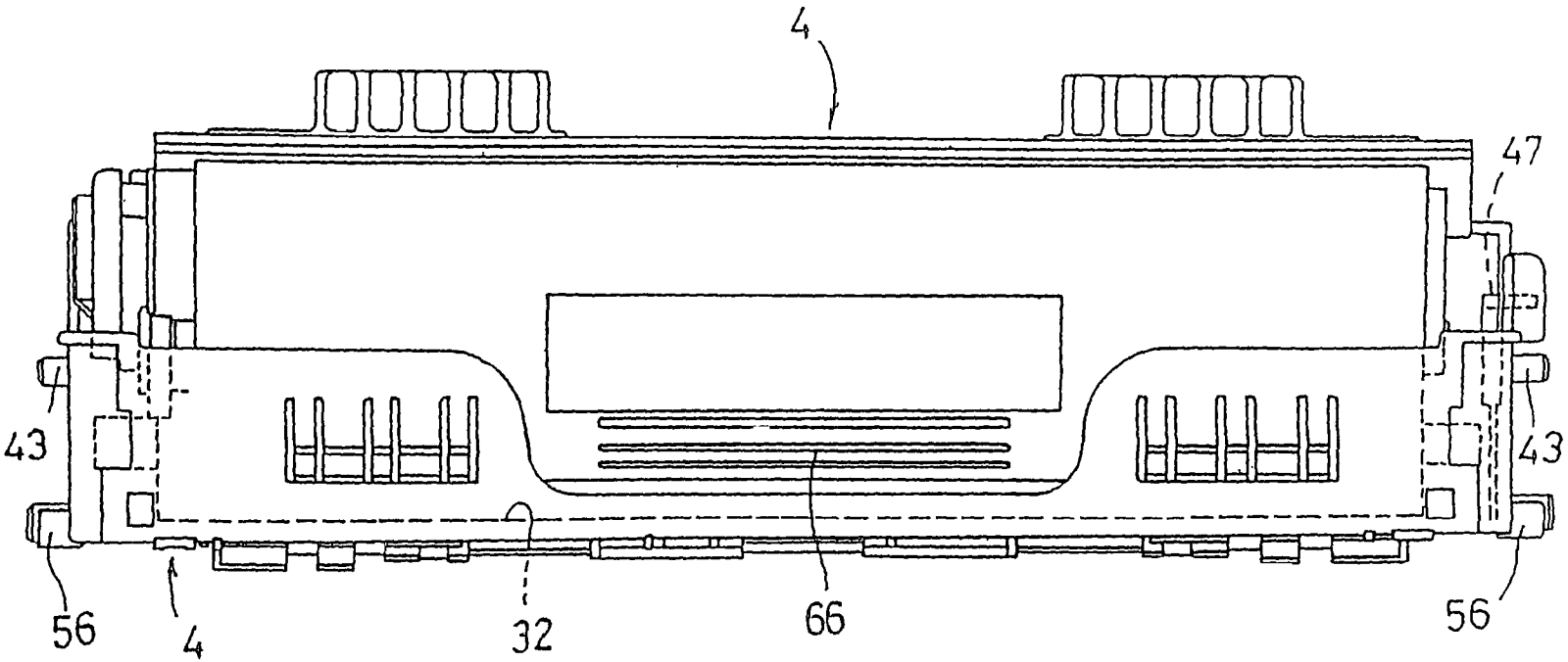
FIG. 19 is a view of the process unit taken in the direction indicated by arrows XIX in FIG. 17.

As shown in FIGS. 16 and 19, the case 21 of the developer cartridge 4 has, in an upper surface portion and a lower surface portion thereof, grip portions 70, 66, respectively, that facilitate the handling of the developer cartridge 4 by an operator.

Figure 17:
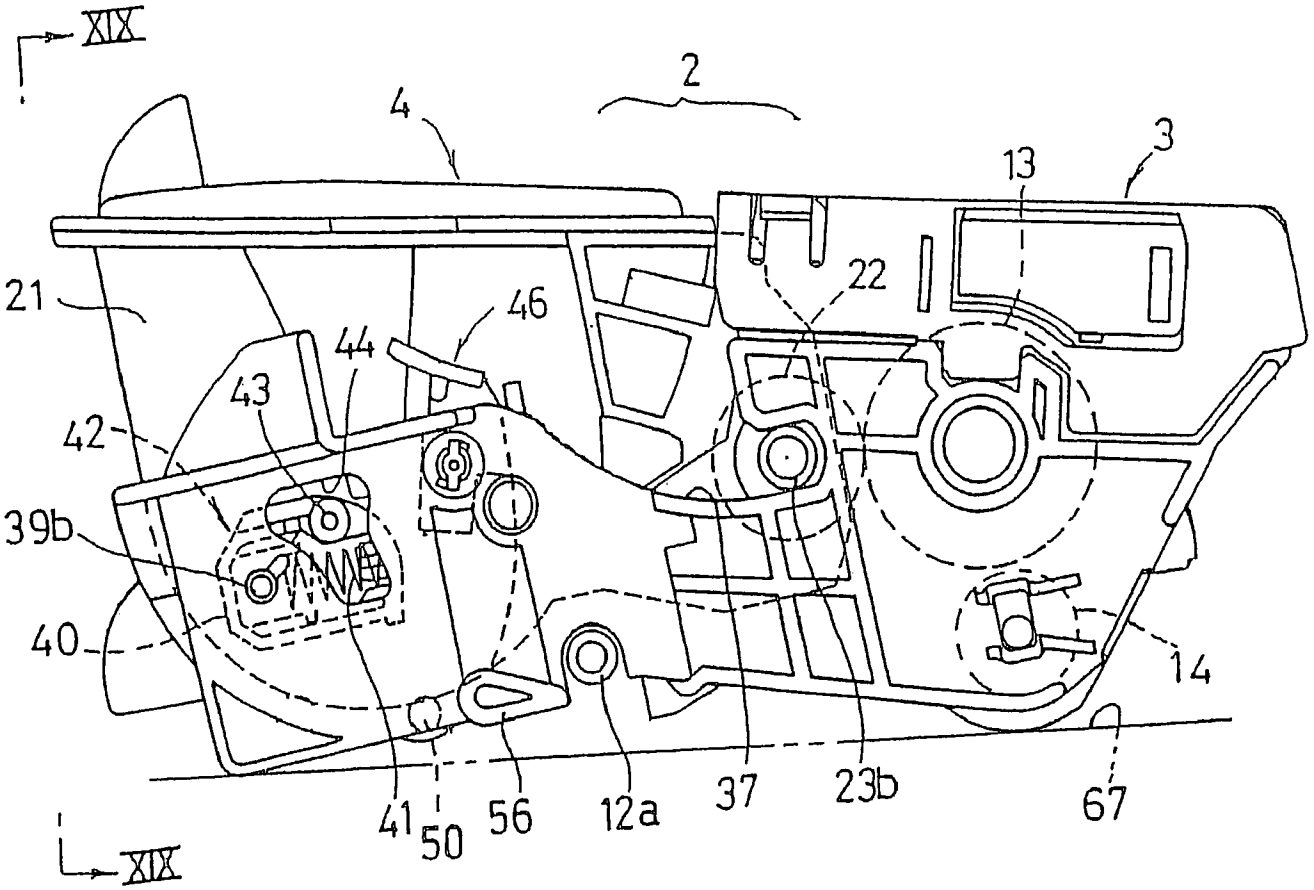
FIG. 17 is a right side view of the process unit.
Figure 18:
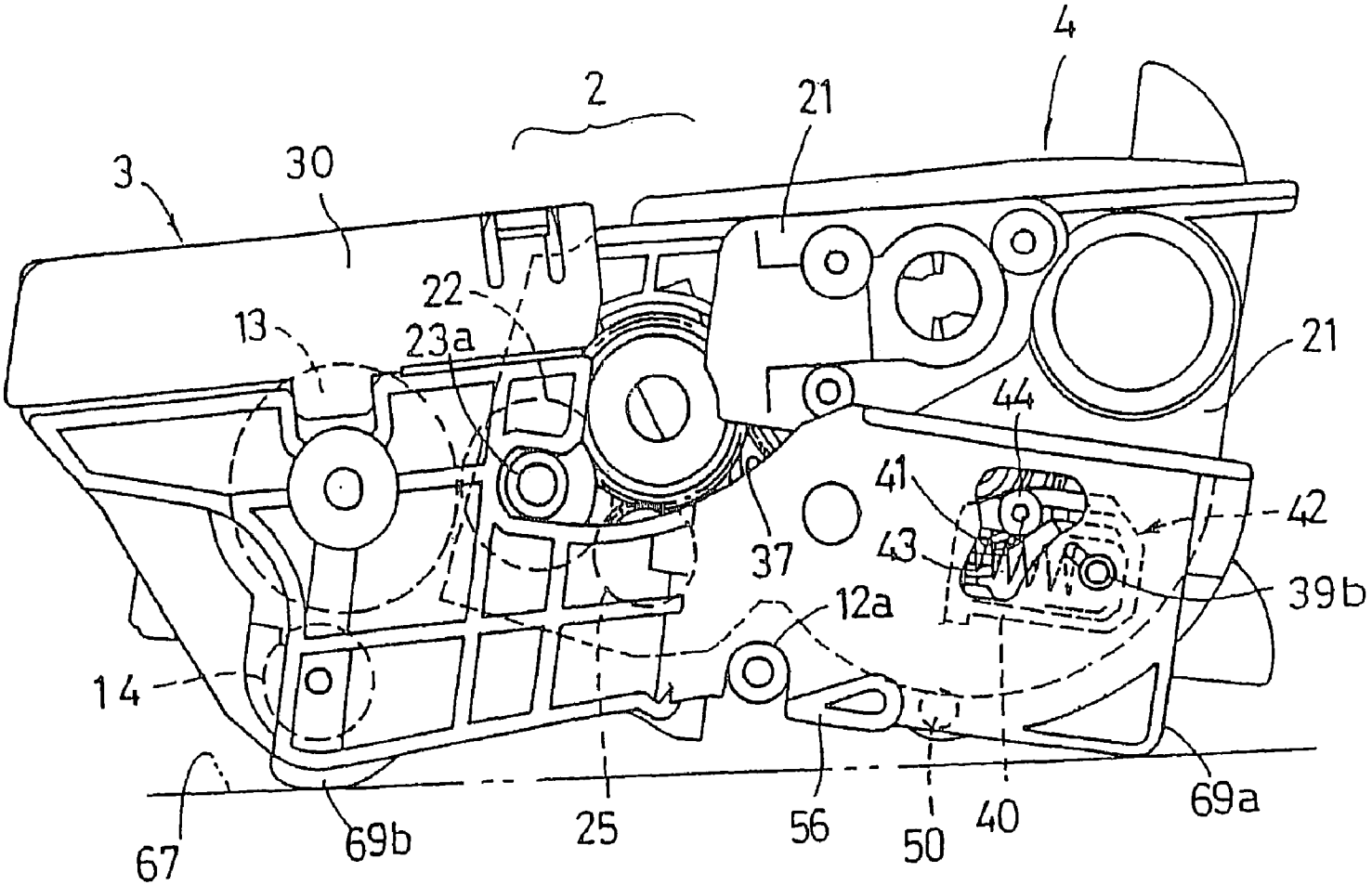
FIG. 18 is a left side view of the process unit.

Further, as shown in FIGS. 17 and 18, the case 30 of the photosensitive member cartridge 3 has foot portions 69*a*, 69*b* at the lower portions thereof, so that the photosensitive member cartridge 3 can be stably placed on the table 67 regardless of whether the photosensitive member cartridge 3 stands alone or is combined with the developer cartridge 4. The foot portions 69*a*, 69*b* need to be provided diagonally at least two positions and, preferably, four positions at each corner of the case 30, as in the embodiment. More foot portions 69*a*, 69*b* may be provided if the space is available on the case 30.

In the embodiment, as shown in FIGS. 5-7, 17, and 18, when the photosensitive member cartridge 3 is viewed from the side, the foot portions 69*a*, 69*b* are provided so as to extend downwardly, at the lower portions of the case 30 near both ends of the forward and rearward sides thereof. The foot portions 69*a*, 69*b* contact the table 67 with the center of gravity of the photosensitive member cartridge 3 placed between the foot portions 69*a*, 69*b*, so that the photosensitive member cartridge 3 is stabilized when it is placed on the table 67.

The case 30 is formed with the upwardly open accommodating portion 32 near one side thereof. The developer cartridge 4 can be removably set into the accommodating portion 32 from above, while the photosensitive member cartridge 3 is placed on the flat surface of the table 67 in a stable posture via the foot portions 69*a*, 69*b*. Therefore, replacement of the developer cartridge 4 can be easily performed.

Figure 7:
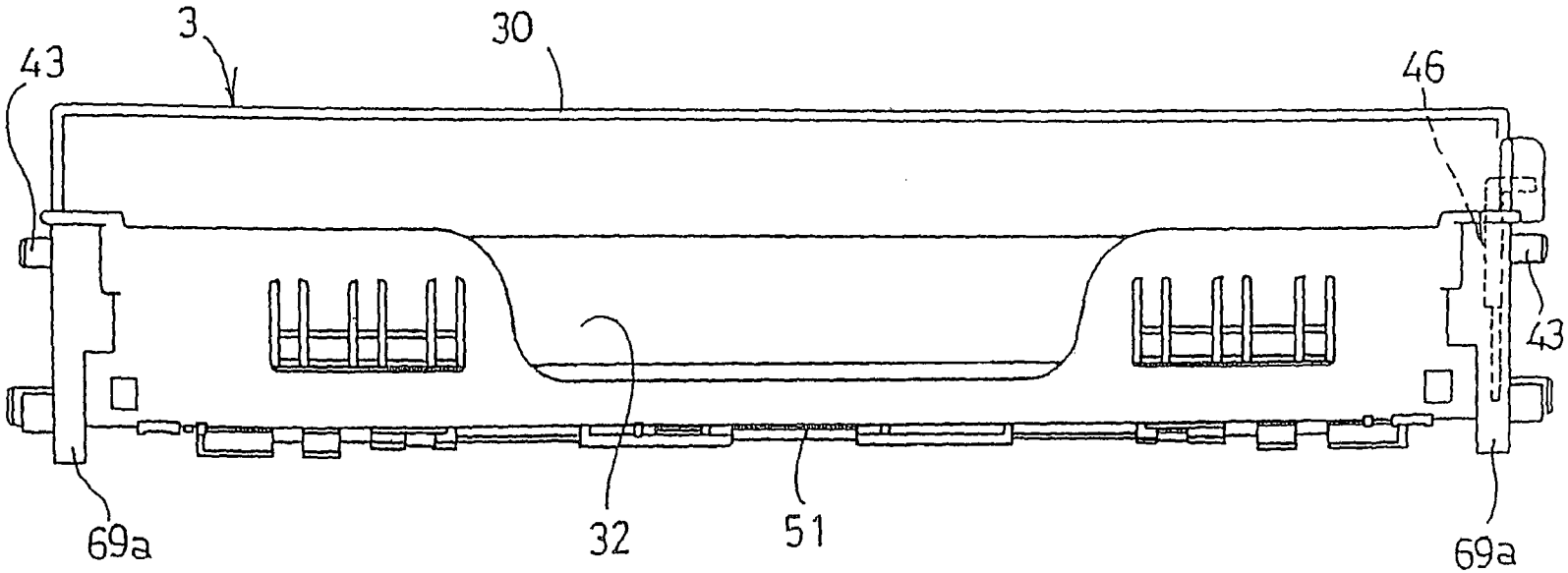
FIG. 7 is a front view of the photosensitive member cartridge.

Preferably, the foot portions 69*a*, 69*b* are provided at the forward and rearward sides of the case 30, so as to place the centers of gravity of both the developer cartridge 4 and the photosensitive member cartridge 3 between the foot portions 69*a*, 69*b*. With such arrangements, the developer cartridge 4 can be set in the photosensitive member cartridge 3, which is placed on the table 67, without causing unstable actions of the photosensitive member cartridge 3, such as swinging. Further, FIG. 7 shows the foot portions 69*a*, 69*b* provided at the right and left side end portions of the lower surface of the case 30. The foot portions 69*a*, 69*b* may be provided at the lowermost portions of the case 30 so as to protrude toward the left and right sides.

The operation of setting the developer cartridge 4 with respect to the photosensitive member cartridge 3 will be described. To set the developer cartridge 4 with respect to the photosensitive member cartridge 3, an operator holds with one hand, the grip portions 70, 66 formed on an upper surface portion and a lower surface portion of the case 21 of the developer cartridge 4. When the developer cartridge 4 is inserted, with the developing roller 22 side being a leading side, into the accommodating portion 32 of the case 30 (inserting operation), one of the action-receiving portions 61 of the developer cartridge 4 contacts the lock lever 47, and turns the lock lever 47 to a position indicated by a two-dot line in FIG. 4, against the force of the resin-made spring 49. When the developer cartridge 4 is thus inserted (the inserting operation is completed), the action-receiving portion 61 is lowered and, therefore, the contact between the action-receiving portion 61 and the lock lever 47 discontinues. Therefore, the lock lever 47 is returned to the position indicated by a solid line in FIG. 4, by the restoration force of the resin-made spring 49, so that the contact portion 47*a* of the lock lever 47 faces an upper surface of the action-receiving portion 61, thereby establishing a locked state. The process unit 2 integrated with the developer cartridge 4 and the photosensitive member cartridge 3, can be raised with one hand by holding the grip portions 70, 66. That is, the operator sequentially can set the process unit 2 into a predetermined portion of the body housing 1 while holding the grip portions 70, 66 after the developer cartridge 4 is set with respect to the photosensitive member cartridge 3.

During the insertion of the developer cartridge 4 into the accommodating portion 32, the shaft bearings 23*a*, 23*b* disposed at the right and left side ends of the developing roller 22 slide down along the guide grooves 37 formed along the upper edges of the right and left side walls 30*c* of the case 30, so as to approach the shaft 13*a* of the photosensitive drum 13. The case 21 of the developer cartridge 4 is pivotable about the bearings 23*a*, 23*b* of the developing roller shaft 22*a* of the developing roller 22 when the bearings 23*a*, 23*b* are supported by the guide grooves 37. Therefore, when the bearings 23*a*, 23*b* come to a position on the guide grooves 37 close to the shaft 13*a* of the photosensitive drum 13 ("U"-shaped portions of the guide grooves 37), a toner containing chamber 24 side portion of the case 21 of the developer cartridge 4 comes into the accommodating portion 32 of the photosensitive member cartridge 3 by a pivoting motion about the developing roller shaft 22*a* of the developing roller 22. Thus, the developer cartridge 4 is fittingly set in the accommodating portion 32.

In this state, the rollers 50 provided on the inner surface of the accommodating portion 32 slidingly contact a lower surface portion of the case 21 on the side of the toner containing chamber 24, and the bearings 23*a*, 23*b* move along the guide grooves 37 to such a position that the developing roller 22 is located substantially closest to the photosensitive drum 13. When the lock lever 47 pivots clockwise to return from the position indicated by the two-dot line to the position indicated by the solid line in FIG. 4, the contact portion 47*a* of the lock lever 47 faces the upper surface (protrusion 61*a*) of the action-receiving portion 61, so that the developer cartridge 4 is prevented from moving out of the photosensitive member cartridge 3.

FIGS. 16 through 19 are a plan view, a right side view, a left side view, and a rear view (a view of the side of the sheet discharge opening) of the process unit 2 with the developer cartridge 4 set with respect to the photosensitive member cartridge 3. Since the urging devices 42 are pressed downward by the action-receiving portions 61 as the developer cartridge 4 is pushed downward into the process unit 2, each urging device 42 normally assumes such a orientation that the motion acting portion 43 is relatively lowered, as shown in FIGS. 2 and 4.

The process unit 2 is designed so that the process unit 2 can be set into, and removed from, the body housing 1 when a lid 1*b* provided in the right-side end in FIG. 1 (a front face) of the body housing 1 is downwardly turned to form a large opening (see FIG. 2).

That is, as shown in FIGS. 2, 20(*a*), 20(*b*) and 21, a pair of right and left guide devices 55, made of a resin or the like, are fixed to the inner surfaces of the right and left side portions of the body housing 1 (in the drawings, only the right-side guide device 55 is shown). Each guide device 55 has a rising slope surface that is open upward and extends upwardly inward from the right-side end of the body housing 1, and an upper-side guide surface 55*a* extending downwardly inward from a summit 55*d* of the rising slope surface, and a lower-side guide surface 55*b* that is disposed below the upper-side guide surface 55*a* and that extends downwardly inward from the right-side end of the body housing 1, and ends at a position near the lower roller 12(*b*) of the pair of register rollers.

FIG. 2 indicates a position at which the insertion of the process unit 2 into the body housing 1 is started. The process unit 2 is inserted into the body housing 1 so that the shaft 13*a* of the photosensitive drum 13 approaches an upper inward end portion 55*c* of the upper-side guide surface 55*a*. Subsequently, as shown in FIG. 20(*a*), the motion acting portion 43 of each urging device 42 contacts the rising slope surface of the upper-side guide surface 55*a*, and each of guiding members 56, protruding laterally from lower portions of the right and left sides of the process unit 2 (photosensitive member cartridge 3), fits into the lower-side guide surface 55*b* (only one of the guiding members 56 is shown in the drawings), so that the process unit 2 is prevented from moving upward relative to the body housing 1, and is allowed only to be moved further inward along the lower-side guide surface 55*b*.

In this state, as the process unit 2 is pushed inward, the motion acting portion 43 of each urging device 42 is raised by the corresponding upper-side guide surface 55*a*, so that the slide support member 40 of each urging device 42 pivots upward about the pivots 39*a*, 39*b*. Therefore, the slide support member 40 of each urging device 42 restrains the corresponding one of the action-receiving portions 61 of the developer cartridge 4 in such a direction that a distal end portion of the slide support member 40 pushes the action-receiving portion 61. When the motion acting portion 43 of each urging device 42 comes to the summit 55*d* of the upper-side guide surface 55*a*, the slide support member 40 of each urging device 42 is pivoted to a most upward orientation. In this orientation, the distal end portion of the slide support member 40 of each urging device 42 keeps restraining the corresponding action-receiving portion 61 (see FIG. 20(*b*)).

As the process unit 2 is pushed further inward, the shaft 13*a* of the photosensitive drum 13 is set to a predetermined position in the inward end portion 55*c* of each upper-side guide surface 55*a*. At this position, an operator releases the process unit 2 from the hands, so that the developer cartridge 4 side portion of the process unit 2 is lowered and set by the weight the process unit 2 into a state such that the upper register roller 12*a* disposed at a lower surface side of the case 30 of the photosensitive member cartridge 3 is placed on the lower register roller 12*b* disposed in the body housing 1, and is pressed by a spring 45 shown in FIG. 2 and, simultaneously, the guiding members 56 are supported at appropriate positions on the guide devices 55 (see FIG. 21).

When the process unit 2 is set as described above, the distal end of the slide support member 40 of each urging device 42 presses the corresponding action-receiving portion 61. Therefore, the developing roller 22 is pressed against the photosensitive drum 13 by the urging devices 42 and the action-receiving portions 61 via the developer cartridge 4.

Figure 21:
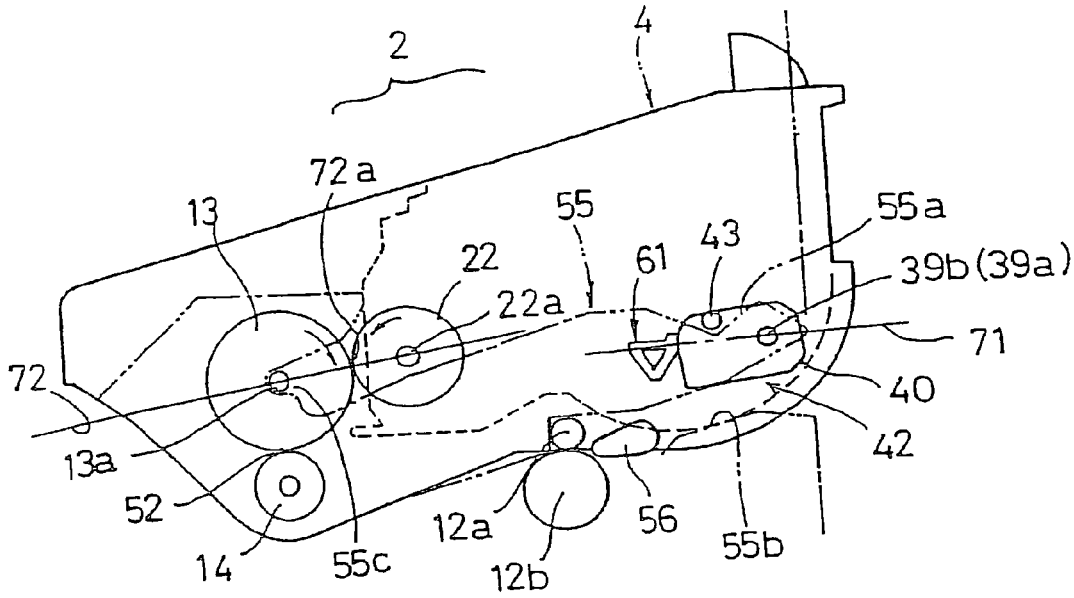
FIG. 21 illustrates a situation in which the process unit has been set in the body housing.

As shown in FIG. 21, it is preferable that a contact portion 72*a* between the photosensitive drum 13 and the developing roller 22, that is, pressed portions thereof at the closest positions, (the contact portion 72*a* is on an inter-axis straight line 72 passing through the axis of the shaft 13*a* of the photosensitive drum 13 and the axis of the developing roller shaft 22*a* of the developing roller 22) be above or on a pressing action line 71 of the action of either one of the urging devices 42 onto the corresponding action-receiving portion 61 (that is, a straight line passing through the pivot 39*a* (39*b*) and a pressing point at which the distal end of the slide support member 40 contacts the action-receiving portion 61), or that the inter-axis straight line 72 substantially coincide with or extend substantially parallel to the pressing action line 71.

Figure 22:
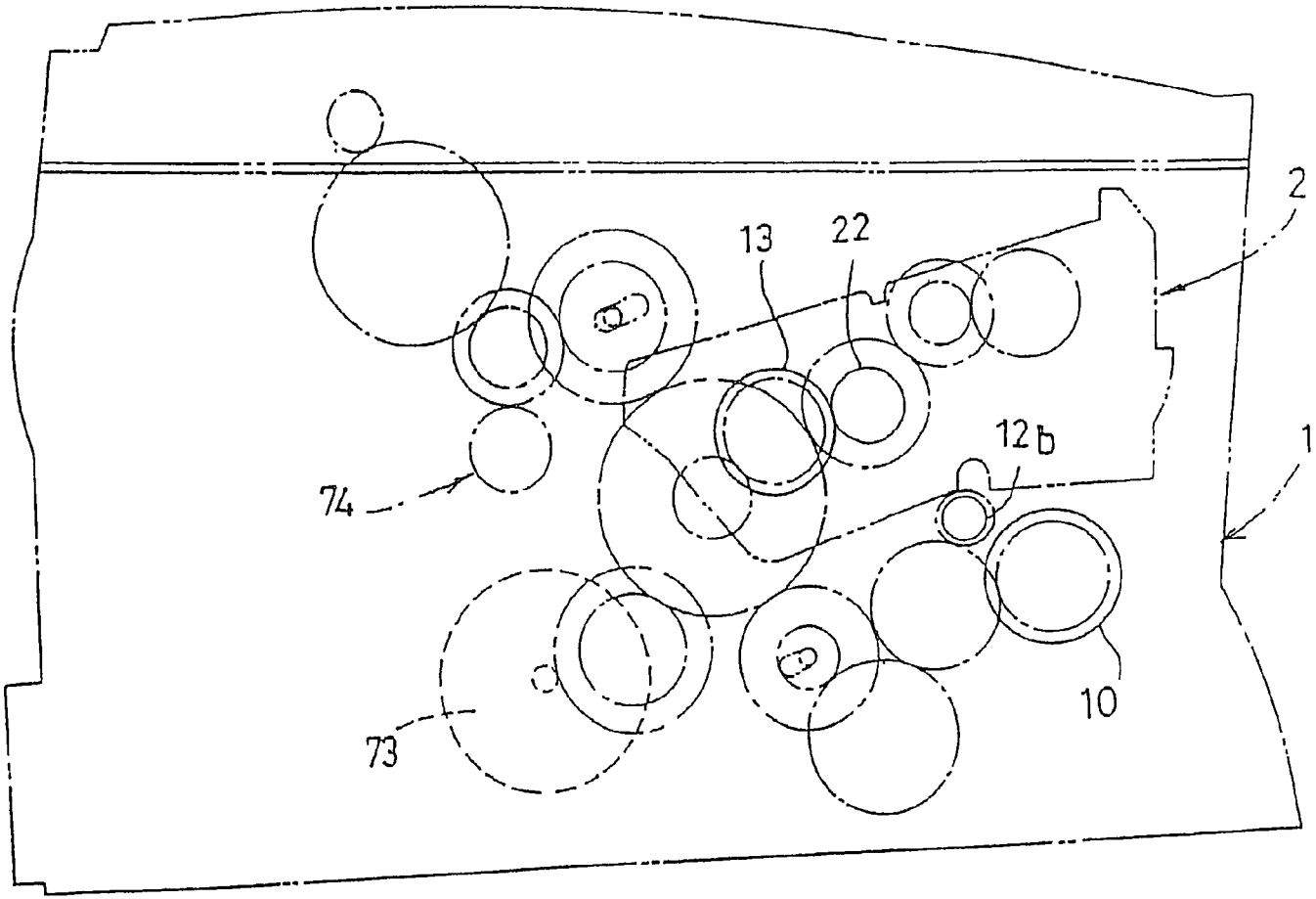
FIG. 22 is an illustration of a drive system of the printer.

As shown in FIG. 22, a gear mechanism 74 that transmits force from a drive motor 73 is disposed on the inner surface of one side (the left side in the embodiment) of the body housing 1. The gear mechanism 74 rotates the sheet feed roller 10 of the sheet feeder 6, the lower register roller 12*b*, the developing roller 22, the photosensitive drum 13, the heat roller 15, and conveying rollers in the sheet discharge passage. The developing roller 22 and the photosensitive drum 13 are rotated in opposite directions, as indicated in FIGS. 1 and 21, that is, the developing roller 22 is rotated counterclockwise and the photosensitive drum 13 is rotated clockwise. Furthermore, the mechanism is designed so that the circumferential velocity of the developing roller 22 is greater than that of the photosensitive drum 13.

Figure 32:
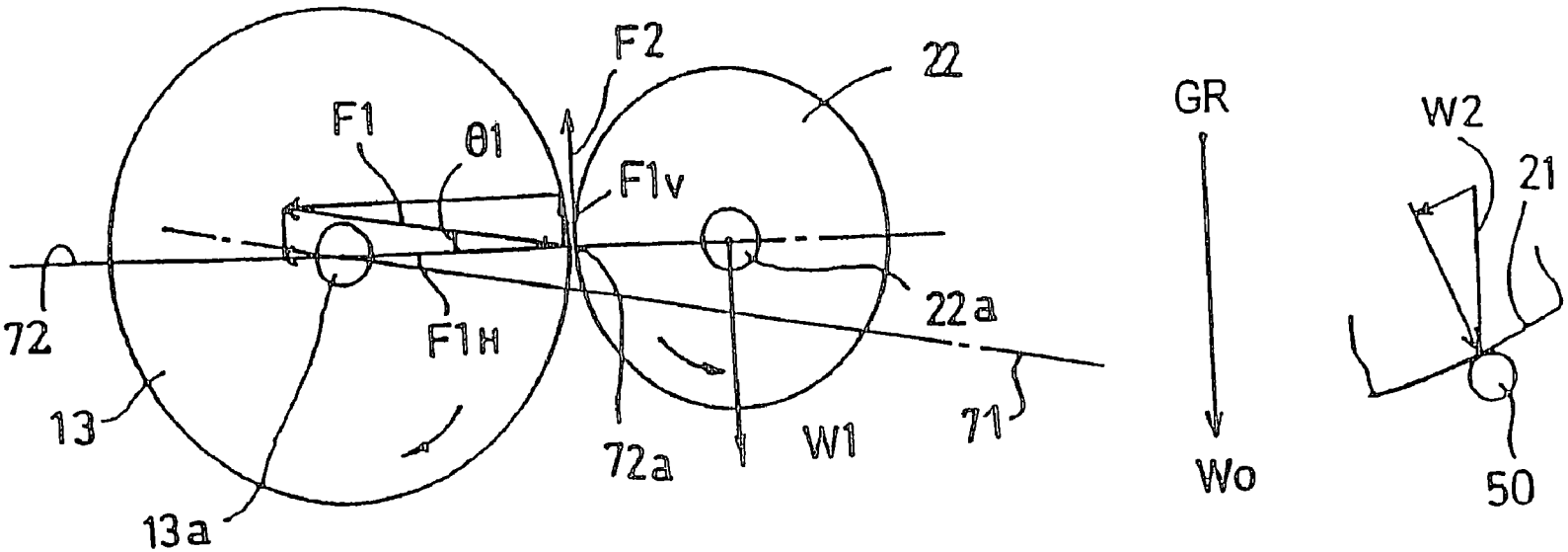
FIG. 32 is an illustration of a force that presses a developing roller against a photosensitive drum and other forces concerned.

Therefore, as shown in FIG. 32, during image forming operation, the direction of a pressing force F1 of each urging device 42 acting on the contact portion 72*a* is parallel to the pressing action line 71, and the pressing force F1 is split into a component F1V in a direction of the tangent of the circumferences of the developing roller 22 and the photosensitive drum 13 and a component F1H in a direction of the inter-axis straight line 72.

The difference in circumferential velocity between the developing roller 22 and the photosensitive drum 13 creates a friction resistance force F2 in an upward direction in FIG. 32 with respect to the developing roller 22 and in a downward direction with respect to the photosensitive drum 13, the friction resistance force F2 having a value equal to a multiplication product of the friction coefficient and the component F1H of the pressing force in the direction of the inter-axis straight line 72 of the photosensitive drum 13 and the developing roller 22. Therefore, the rotation moment caused by the friction resistance force F2 acting on the developer cartridge 4 acts about the developing roller shaft 22*a* in a clockwise direction in FIG. 32.

If the pressing action line 71 extends above the developing roller shaft 22*a*, a rotation moment acts on the developer cartridge 4 about the developing roller shaft 22*a* counter clockwise in FIG. 32, and reduces or offsets the rotation moment caused by the friction resistance force F2. In such a case, the developer cartridge 4 tends to rise, which is unfavorable. In this invention, however, the position of the developing roller shaft 22*a* is above or on the pressing action line 71, or the inter-axis straight line 72 substantially coincides with, or extend substantially parallel to, the pressing action line 71. Therefore, during image formation, the developing roller 22 is substantially prevented from rising, and stable pressing action can be achieved.

Furthermore, the pressing structure is formed by the urging devices 42 for pressing the developing roller 22 against the photosensitive drum 13, and the action-receiving portions 61 provided on the developer cartridge 4. The action-receiving portions 61 are disposed at a side of the developing roller 22, the side being remote from the photosensitive drum 13. Therefore, the photosensitive drum 13, the developing roller 22 and the drive mechanisms will not become impediments, and the pressing action line 71 and the inter-axis straight line 72 can easily be set substantially parallel to each other and adjacent to each other.

If the developer cartridge 4 is supported pivotably about the developing roller shaft 22*a* of the developing roller 22 while image forming operation is being performed, with the developer cartridge 4 set with respect to the photosensitive member cartridge 3, that is, if the arrangement is set such that during image forming operation, the bearings 23*a*, 23*b* on both ends of the developing roller shaft 22*a* of the developing roller 22 are stopped at the inward sides of the guide grooves 37 of the photosensitive member cartridge 3 and therefore prevented from moving further inward, and the weight Wo of the developer cartridge 4 is dispersedly supported at two positions in a side view, that is, the position of the shaft bearing 23*a* (23*b*), and a position at a side of the developing roller shaft 22*a* remote from the photosensitive drum 13, for example, a position at which the bottom of the toner containing chamber 24 contacts the rollers 50, or the like, so that split loads W1, W2 of the weight Wo are supported at the two positions (see FIG. 32), then the direction of the rotation moment about the axis (the developing roller shaft 22*a*) of the developing roller 22 caused by the friction resistance force F2 received by the developing roller 22 from the photosensitive drum 13 becomes the same as the direction of the rotation moment about the axis (the developing roller shaft 22*a*) of the developing roller 22 caused by the weight (load Wo at the center of gravity G) of the developer cartridge 4, that is, the clockwise direction in FIG. 32. Therefore, during image forming operation, the aforementioned friction resistance force F2 does not act as a moment in such a direction as to raise the developer cartridge 4 against the weight (load Wo at the center of gravity G) of the developer cartridge 4, so that the behavior of the developer cartridge 4 stabilizes.

In the above-described structure, the urging devices 42 are disposed at positions that are within the accommodating portion 32 in the photosensitive member cartridge 3, and that become remote from the developing roller 22 of the developer cartridge 4 when the developer cartridge 4 is set in the accommodating portion 32. The action-receiving portions 61 protrude outward from outer walls of the developer (toner) containing chamber 24, which is disposed at a side remote from the developing roller 22. Therefore, these component parts are unlikely to interfere with the operations of inserting or removing the developer cartridge 4.

In the embodiment of the invention, the urging devices 42, having a relatively complicated structure are disposed in the photosensitive member cartridge 3, which requires less frequent replacement. The action-receiving portions 61 having a relatively simple structure, are disposed in the developer cartridge 4, which requires frequent replacement. Therefore, the production costs of the process unit 2 and the developer cartridge 4 can be reduced, and the running cost can be reduced. Furthermore, since the protruded action-receiving portions 61 provided on the developer cartridge 4 are integral with the side surfaces of the case 21, the action-receiving portion 61 can be formed together with the case 21, thereby reducing the production cost and, further, making it easier for the action-receiving portions 61 to be pressed by the slide support members 40 of the urging devices 42 provided on the photosensitive member cartridge 3.

The right and left urging devices 42 are disposed on inner surfaces of the right and left sides of the photosensitive member cartridge 3, and are connected thereto in such a manner that the urging devices 42 are capable of changing the orientation between a direction of the urging force thereof and a non-urging direction. Therefore, if the developer cartridge 4 is simply placed over or adjacent to the photosensitive member cartridge 3, the developing roller 22 is not pressed against the photosensitive drum 13. Hence, the photosensitive member cartridge 3 and the developer cartridge 4 can be combined as a process unit 2 for packing and shipping, while obviating the danger of permanent deformation of the outer peripheral surface of the process unit 2, or the danger of contamination of the photosensitive drum 13 with material components from the developing roller 22.

Still further, since each urging device 42 is substantially made up of the pivot fulcrum member 39, the slide support member 40 slidable relative to the pivot fulcrum member 39, and the urging spring device 41 disposed between the two members, the urging devices 42 gain an increased degree of freedom in changing the orientation between the urging direction and the non-urging direction, compared with a conventional device that employs an urging spring to directly press an action-receiving portion and discontinue the pressing. Another advantage that the operations of pressing the action-receiving portions 61, and discontinuing the pressing, can be reliably performed by the slide support members 40 can also be achieved.

Further, since each urging device 42 is rotatably connected at its pivot fulcrum member 39 to the inner surface of the right or left side of the case 30 of the photosensitive member cartridge 3, most of the component parts of the urging devices 42 are unexposed outside the case 30, regardless of whether the photosensitive member cartridge 3 stands alone or is combined with the developer cartridge 4 into the process unit 2. Therefore, the danger of accidentally hitting and breaking any component part of the urging devices 42 is considerably reduced, and the ease of handling improves.

The slide support member 40 of each urging device 42 is provided integrally with the pin-like motion acting portion 43 protruding laterally to guide the slide support member 40 into the urging direction and the non-urging direction. The motion acting portions 43 of the urging devices 42 protrude outward from guide holes 44 in the right and left sides of the case 30 of the photosensitive member cartridge 3. Thus, most of the component parts of the urging devices 42 are unexposed outside the case 30. Therefore, the danger of accidentally hitting and breaking any component part of the urging devices 42 is considerably reduced, and the ease of handling improves.

The action-receiving portions 61 protruding outwardly from the right and left sides of the case 21 of the developer cartridge 4 perform the function to be pressed by the urging devices 42 and the function to cooperate with the lock lever 47 of the lock device 46 to prevent the developer cartridge 4 from rising relative to the photosensitive member cartridge 3. Since the action-receiving portions 61 thus perform the two functions, the predetermined cost of the developer cartridge 4 can be considerably reduced.

The process unit 2 is designed so as to be removably set into the body housing 1 of the image forming apparatus. The body housing 1 is provided with the guide devices 55 that guide the urging devices 42 and switch the urging devices 42 between the urging state and the non-urging state. Therefore, the orientation of the urging devices 42 and the operation thereof will be changed or switched simply by setting the process unit 2 into the body housing 1 or removing the process unit 2 from the body housing 1. Thus, the ease of operation considerably improves.

The upper wall 30*b* of the case 30 covers an upper portion of the photosensitive drum 13. The rear wall 30*e*, extending downwardly from the upper wall 30*b*, covers a rear portion of the photosensitive drum 13. The bottom wall 30*a* covers a lower portion of the transfer roller 14 disposed below the photosensitive drum 13. Therefore, exposed portions on the photosensitive drum 13 are very small. The right and left side walls 30*c* cover each end of the transfer roller 14 and the photosensitive drum 13. The case 30 is rigidly and integrally formed of synthetic resin, so that an operator will not touch the surface of the photosensitive drum 13. The case 30 also prevents dust from adhering to the photosensitive drum 13. The operator can securely handle the photosensitive drum 13.

Further, the bottom wall 30*a* of the case 30 extends toward the direction away from the photosensitive drum 13. Holding such an extending portion of the bottom wall 30*a* and the rear wall 30*e* by both hands, an operator will not touch the photosensitive drum 13, and can stably handle the photosensitive member cartridge 3. While the operator is holding the extending portion of the bottom wall 30*a* and the rear wall 30*e*, the bottom wall 30*a* does not flex since the case 30 is a rigid body having a cross-sectional profile which is substantially concave, with the bottom wall 30*a* connected to the right and left side walls 30*c* of the case 30. Therefore, the case 30 can be securely handled.

Also, the light entrance portion 31, allowing irradiation of an upper surface of the photosensitive drum 13 with laser light emitted from the laser scanning unit 7, and the charger 36 that charges a photosensitive surface of the photosensitive drum 13 provided in the upper wall 30*b*, make the case 30 sturdy.

Since the upwardly open accommodating portion 32 is formed by extending the bottom wall 30*a* and the right and left side walls 30*c* to accommodate the developer cartridge 4 therein, the handling of the photosensitive member cartridge 3 with the developer cartridge 4 set therein can be easily performed.

The accommodating portion 32 covers the lower surface and the peripheral surfaces of the developer cartridge 4 when the developer cartridge 4 is set therein. Also, the accommodating portion 32 is open upwardly, so that the case 21 of the developer cartridge 4 set in the accommodating portion 32 is detached therefrom in such a direction that the developing roller 22 travels away from the photosensitive drum 13. Thus, the operation of setting the developer cartridge 4 into the accommodating portion 32, or removing the developer cartridge 4 from the accommodating portion 32, can be easily performed.

The bottom wall 30*a* has an introduction hole 51*a* to introduce the sheet P. The upper surface of a portion of the bottom wall 30*a* has many extending ribs 53 to smoothly convey the sheet P from the introduction hole 51*a* to the contact portion, between the lower surface of the photosensitive drum 13 and the upper surface of the transfer roller 14. The ribs 53 guide the sheet P and increase the rigidity to the bottom wall 30*a*. When the developer cartridge 4 is set into the accommodating portion 32, the ribs 53 face the lower surface of the developer cartridge 4. The space between the ribs 53 and the lower surface of the developer cartridge 4, becomes the path of the sheet P. Thus, the sheet conveying structures are simplified.

If the area of the bottom wall 30*a* covering the lower portion of the transfer roller 14 is increased, the wider portions of the exposed surfaces of the transfer roller 14 and the photosensitive drum 13 are covered, without increasing resistance when the sheet P is conveyed, since the introduction hole 51*a* and the discharge hole 51*b* are provided.

Even if the photosensitive member cartridge 3 remains removed from the body hosing 1 for a long time, the danger of permanent deformation of the outer peripheral surface of the transfer roller 14, or the danger of contamination of the photosensitive drum 13 with chemicals from the transfer roller 14, is obviated, since the photosensitive member cartridge 3 has the rigid case 30 on the peripheral surface thereof.

When the case 30 is set in a predetermined position with respect to the body housing 1, the bearings 35 fitted to both end portions of the transfer roller 14 are raised by the shaft bearing raisers 34 and the springs 33, so that the transfer roller 14 is moved upward to press the photosensitive drum 13. By the simple operation of setting the case 30 into the body housing 1, or removing the case 30 from the body housing 1, pressures can be applied to, or removed from, the transfer portion 52.

When the photosensitive member cartridge 3 is removed from the body housing 1, the transfer roller 14 separates from the lower surface of the photosensitive drum 13 due to the weight of the transfer roller 14. Therefore, even when a sheet P becomes jammed at the transfer portion 52, the sheet P restrained at the transfer portion 52 can be released by only removing the photosensitive member cartridge 3 from the body housing 1. Then, by removing the sheet P from the transfer portion 52 through the introduction hole 51*a*, or the discharge hole 51*b*, the paper jam can be easily cleared.

Register rollers 12*a*, 12*b* are a pair of rollers to convey the sheet P supplied from the sheet feeder 6 to the contact portion between the photosensitive drum 13 and the transfer roller 14, while timing is being provided. The upper register roller 12*a* is provided on the side of the process unit 2. The lower register roller 12*b* is provided on the side of the body housing 1. In this embodiment, the process unit 2 is designed so that the process unit 2 can be removably set in the body housing 1 from the front face thereof. When both register rollers 12*a* and 12*b* are provided to the body housing 1 as in a conventional apparatus, a portion of the case 30 covering the transfer roller 14 comes into contact with the upper register roller 12*a* when the process unit 2 is removed from the front face of the body housing 1, as can be seen from FIG. 1. This makes the removal of the process unit 2 from the body housing 1 difficult.

By providing the upper register roller 12*a* on the side of the process unit 2, the removal of the process unit 2 from the front face of the body housing 1 can be facilitated. The process unit 2 is set in the body housing 1 while moving inside the body housing 1 in a direction substantially parallel to the feeding direction of the sheet P conveyed by the pair of register rollers 12*a*, 12*b*.

However, when the upper register roller 12*a* and the lower register roller 12*b* are provided on the sides of the process unit 2 and the body housing 1, respectively, to facilitate the setting of the process unit 2 into the body housing 1 or the removal of the process unit 2 from the body housing 1, it is important to maintain the appropriate positions, angles, and pressing pressures of the upper and the lower register rollers 12*a* and 12*b* with respect to each other to stably convey the sheet P.

Even when the process unit 2 is replaced with a new one, the new process unit 2 needs to be set in the body housing 1 while the appropriate positions, angles, and the pressing pressures of the upper and the lower register rollers 12*a* and 12*b* are being maintained with respect to with each other.

In the embodiment, the positioning mechanism of the pair of register rollers 12*a*, 12*b* is constructed as described below.

Figure 23:
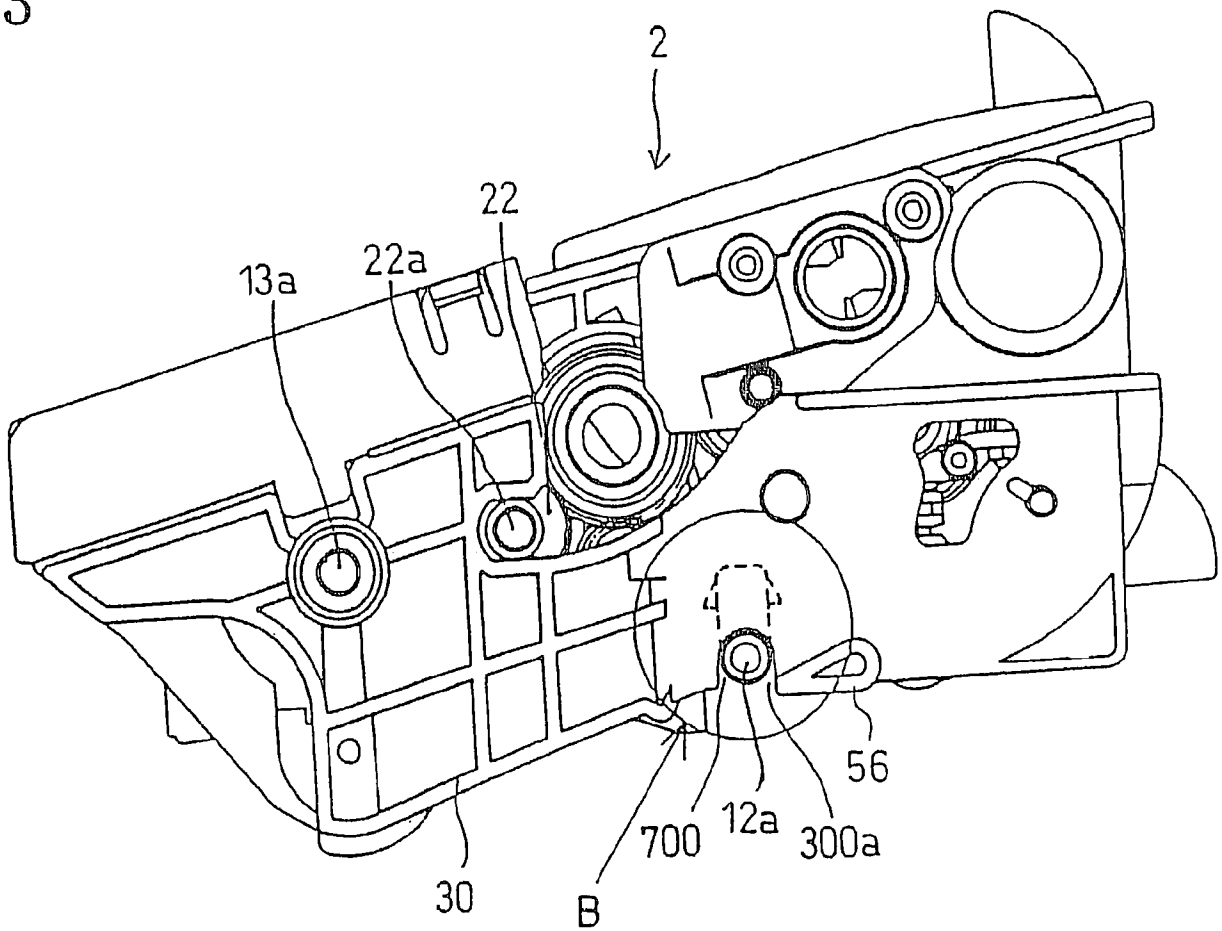
FIG. 23 is a plan view of the process unit showing the upper register roller 12*a* provided so as to expose its surface from the bottom opening 300*a* of the case 30.
Figure 24:
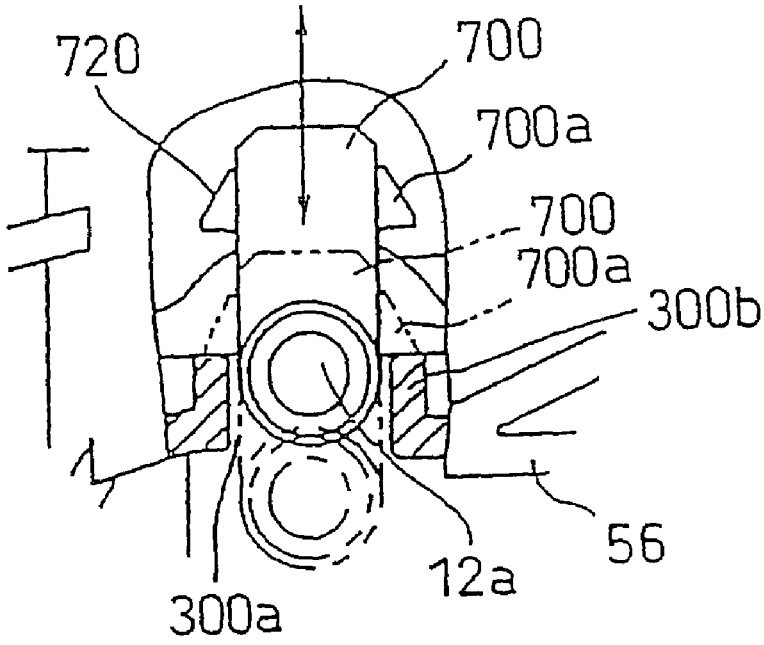
FIG. 24 is an enlarged view of the circled portion B of FIG. 23.

As shown in FIG. 23, the upper register roller 12*a* is provided so as to expose its surface from the bottom opening 300*a* of the case 30. Unlike a general roller journaled in the side surfaces of an apparatus body or case, the register roller 12*a* is provided in the following manner. As shown in FIG. 24, which is a enlarged view of the circled portion B in FIG. 23, protrusions 700*a* of a bearing 700 fitted to the register roller 12, contact supporting portions 300*b* integrally formed with the case 30. The register roller 12*a* is disposed so as to vertically move in the directions indicated by an arrow in FIG. 24 (the direction such that the register roller 12*a* is pressed against the register roller 12*b* and the opposite direction).

Figures 25A, 25B, 25C, 25D, 25E, 25F, 25G, 25H, 25I:
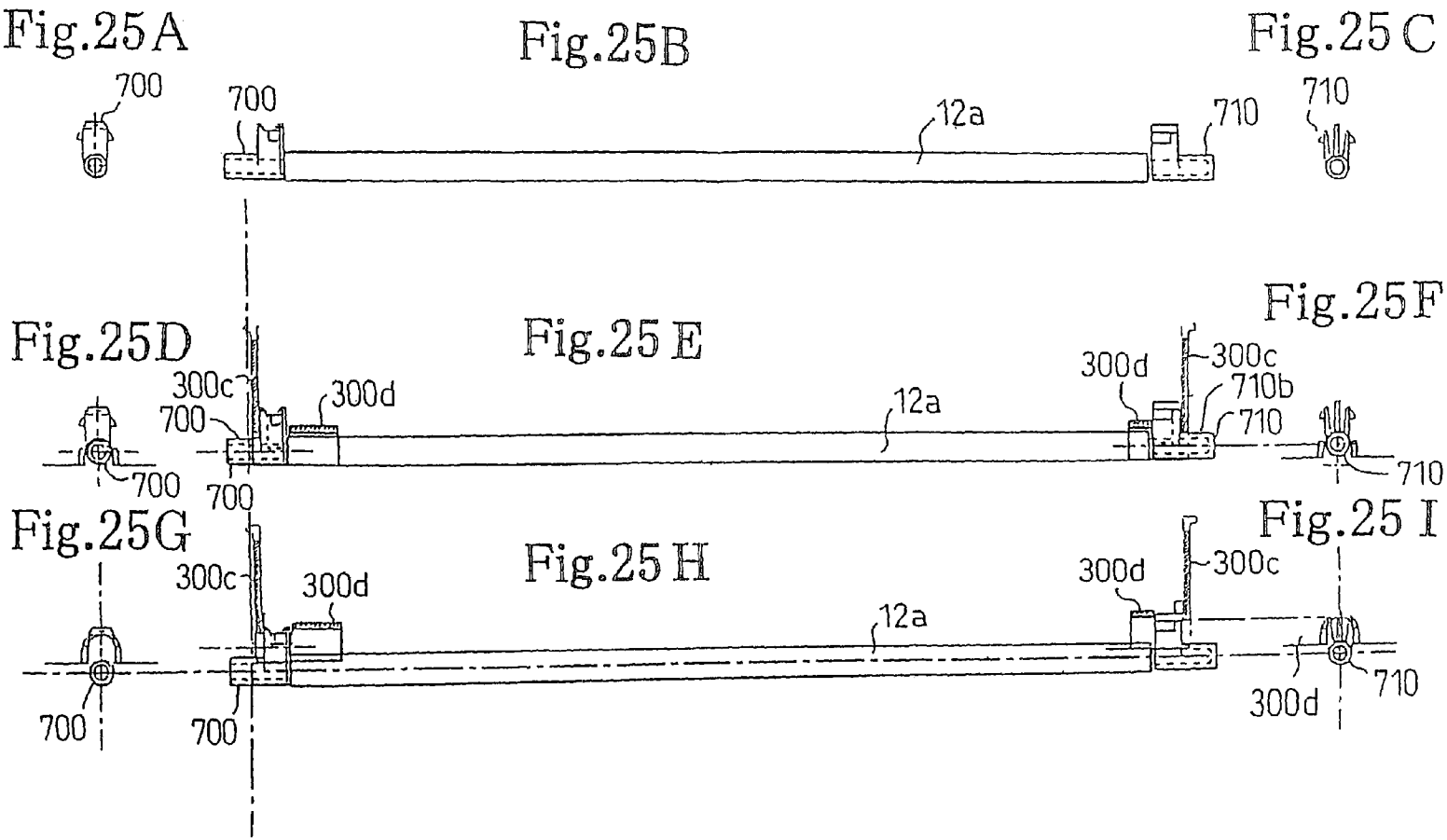
FIGS. 25A-25I are views showing the register roller 12*a* and bearings 700, 710.
Figure 26A:
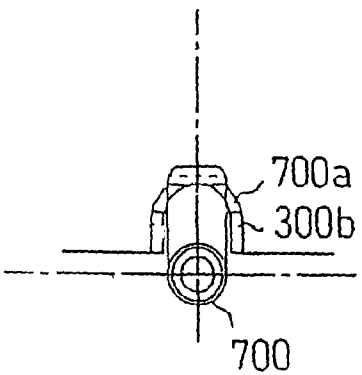
FIGS. 26A-26D are views showing the bearings 700, 710 and the supporting portion 300*b* of the case 30.
Figure 26B:
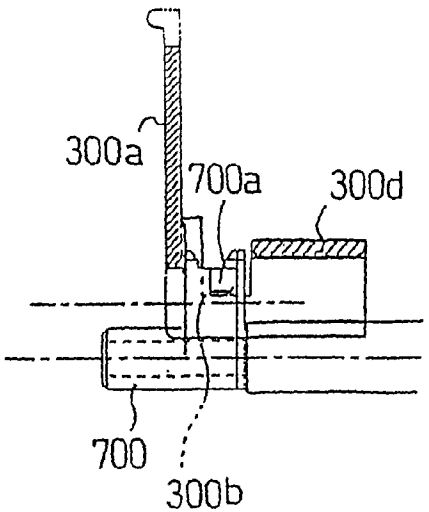
Figure 26C:
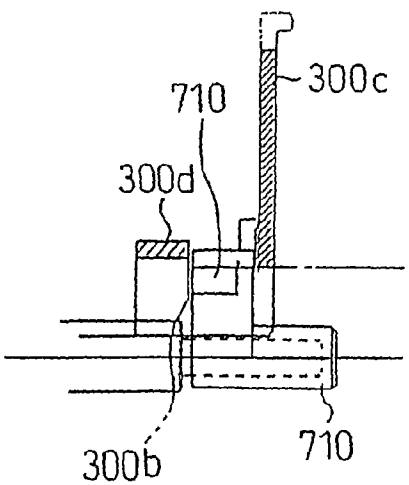
Figure 26D:
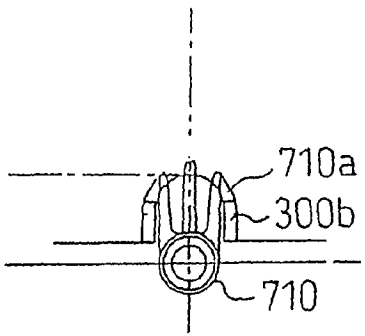

As shown in FIG. 25B, the register roller 12*a* is a shaft formed by plated iron or stainless steel. The length of the register roller 12*a* is longer than the width of the sheet P. Bearings 700, 710 made of resin are disposed to each end of the register roller 12*a*. As shown in FIGS. 25A and 27A through 27F, the bearing 700 is provided with a integrally-formed cylindrical portion 700*b* with an insertion hole 700*c* for inserting an end of the register roller 12*a* and a supporting portion 700*d* formed with protrusions 700*a*.

Figure 28A:
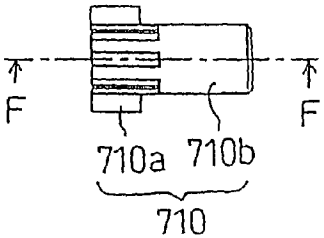
FIGS. 28A-28E are views showing the bearing 710.
Figure 28B:
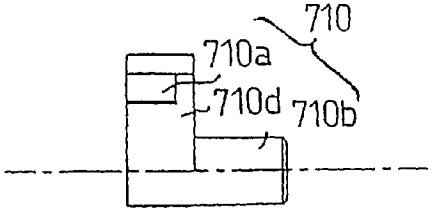
Figure 28C:
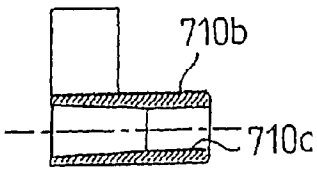
Figure 28D:
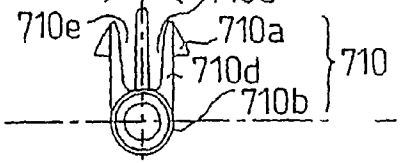
Figure 28E:
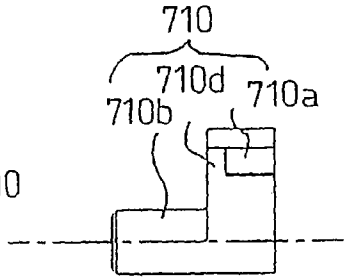

To the other end of the register roller 12*a*, the bearing 710 is disposed. As shown in FIGS. 25C and 28A through 28E, the bearing 710 has substantially the same shape as the bearing 700, except for a cavity 710*e*. That is, the bearing 710 is provided with a integrally-formed cylindrical portion 710*b* with an insertion hole 710*c* for inserting an end of the register roller 12*a* and a supporting portion 710*d* formed with protrusions 710*a* and the cavity 710*e*, as shown in FIG. 28D. Due to the cavity 710*e*, the supporting portion 710*d* is easy to flex inward (toward the central portion thereof), as shown by arrows in FIG. 28D.

After the above-described bearings 700, 710 are fitted to each end of the register roller 12*a*, as shown in FIG. 25B, the register roller 12*a* is mounted to the case 30 as described below.

Figure 29:
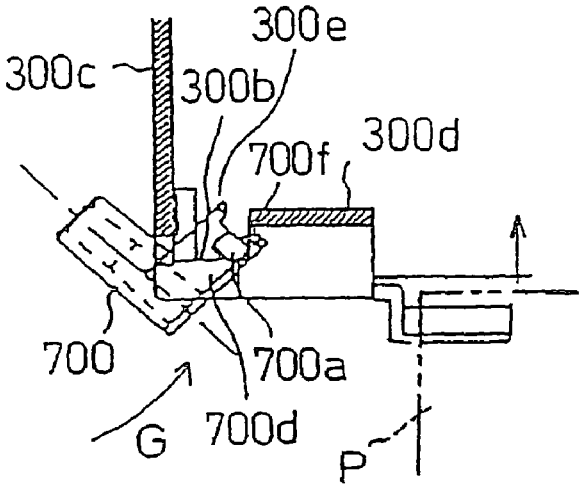
FIG. 29 is a view showing the bearing 700 with a bearing chamfered portion 700*f* and side wall 300*c* with a gap 300*e;*

As shown in FIG. 29, the bearing 700 is first inserted into a gap 300*e* defined between a side wall 300C of the case 30 and a bottom wall 300*d* that covers an end portion of the register roller 12*a*, at such an angle indicated in FIG. 29. Then, the bearing 700 is pushed to the direction indicated by the arrow G. As shown in FIG. 29, a chamfered portion 700*f* having a slanted surface is formed on the upper end portion of the supporting portion 700*d* above the protrusions 700*a*. The chamfered portion 700*f* smoothly makes contact with the corner of the bottom wall 300*d*, so that the bearing 700 can be smoothly fitted into the gap 300*e*.

Figure 27A:
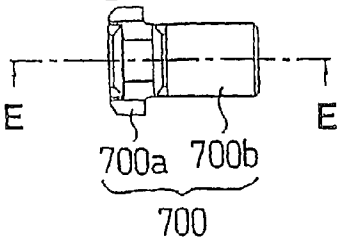
FIG. 27A-27F are views showing the bearing 700.
Figure 27B:
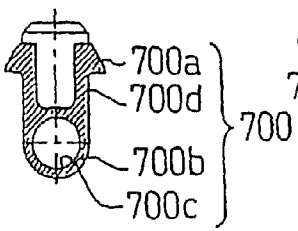
Figure 27C:
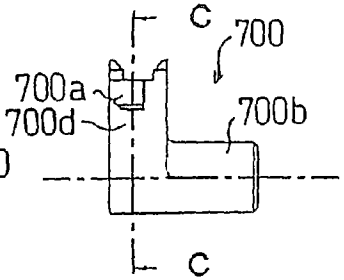
Figure 27D:
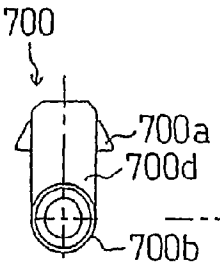
Figure 27E:
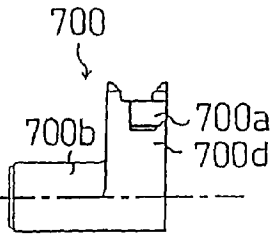
Figure 27F:
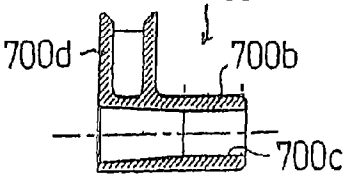
Figure 30:
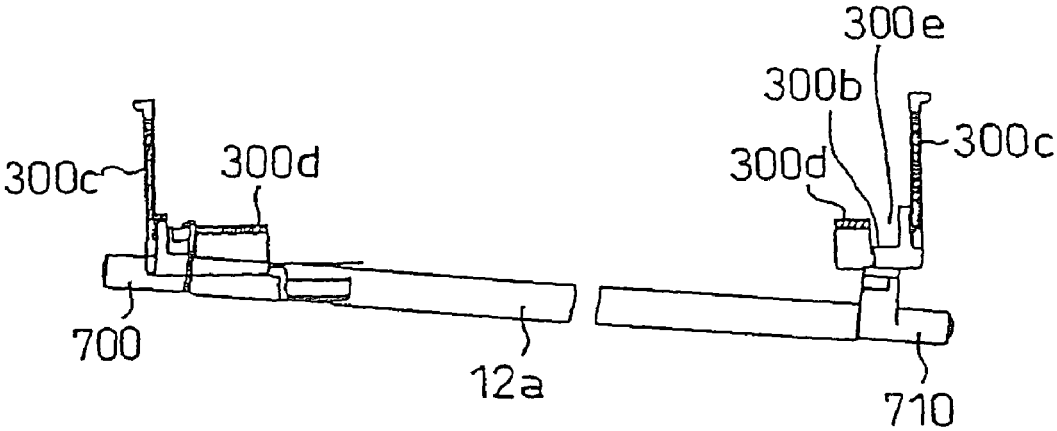
FIG. 30 is a view showing the register roller 12*a*, and bearings 700, 710.

As shown in FIGS. 24 and 27D, an inclined surface 720 is formed on the protrusion 700*a*. The inclined surface 720 smoothly makes contact with the supporting portions 300*b*, so that the bearing 700 can be easily fitted into the gap 300*e*. The thus fitted bearing 700 into the gap 300*e* is shown in FIG. 30.

To fit the bearing 710 into the gap 300*e*, the supporting portion 710*d* is flexed inward (toward the central portion thereof) as indicated by the arrows in FIG. 28D. While flexing the supporting portion 710*d*, so as to narrow the width thereof, the bearing 710 is pushed into the gap 300*e*. The flexible supporting portion 710*d* makes the insertion of the bearing 710 into the gap 300*e* easy. An inclined surface 730 is also formed on the protrusions 710*a* of the bearing 710, as shown in FIG. 28D. The inclined surface 730 smoothly makes contact with the supporting portions 300*b*, so that the bearing 710 can be easily fitted into the gap 300*e*.

FIGS. 25D through 25I show the bearings 700, 710 fitted into the gaps 300*e* in such a manner as described above. As shown in FIGS. 25D through 25I, when the register roller 12*a* is moved up to the highest position where the cylindrical portions 700*b*, 710*b* of the bearings 700, 710, respectively, contact the lower ends of the side walls 300*c*, the further upward movement of the register roller 12*a* is restricted due to the bearings 700, 710 outwardly extending from the side wall 300*c*. As shown in FIGS. 26A through 26D, which are enlarged views of the bearings 700, 710 and their periphery shown in FIGS. 25G-25I, when the register roller 12*a* is moved down to the lowest position due to its own weight, the further downward movement of the register roller 12*a* is restricted by contacting the protrusions 700*a*, 710*a* to the supporting portions 300*b*.

The above-described structure enables the register roller 12*a* to move freely up and down in the direction such that the register roller 12*a* separates from and presses against the register roller 12*b*.

As shown in FIG. 1, the register roller 12*b* has a shaft 12*c* formed of plated iron or stainless steel and an elastic layer 12*d* formed of urethane rubber and which is provided on the shaft 12*c*. The shaft 12*c* is rotatably supported in the body housing 1. The shaft 12*c* is connected to a motor via a gear (not shown). The timing of starting the rotation of the register roller 12*b* and the speed thereof are controlled by a controller (not shown).

As described above, the register roller 12*a* is provided so as to vertically move. The register roller 12*a* is positioned so as to maintain the appropriate position, angle, and the pressing pressure with respect to the register roller 12*b*, when the process unit 2 is set in the body housing 1.

With reference to FIGS. 2, 9, 20A, 20B, 21, and 31, the operation of setting the process unit 2 into the body housing 1 and the mechanism of positioning the register roller 12*a* will be described below.

The process unit 2 is set into, and removed from, the body housing 1 when a lid 1*b*, provided in the right-side end in FIG. 1 (a front face) of the body housing 1, is downwardly turned to form a large opening. As shown in FIG. 2, a pair of right and left guide devices 55, made of resin, are fixed to the inner surfaces of the right and left side portions of the body housing 1. Each guide device 55 has a rising slope surface that is open upward and extends upwardly inward from the right-side end of the body housing 1, and an upper-side guide surface 55*a* extending downwardly inward from a summit 55*d* of the rising slope surface, and a lower-side guide surface 55*b* that is disposed below the upper-side guide surface 55*a* and that extends downwardly inward from the right-side end of the body housing 1, and ends at a position near the register roller 12*b*.

FIG. 2 indicates a position at which the insertion of the process unit 2 into the body housing 1 is started. When the process unit 2 is inserted into the body housing 1 from a position shown in FIG. 2 to a position shown in FIG. 20A, the process unit 2 is pushed inward so that the shaft 13*a* of the photosensitive drum 13 approaches an inward end portion 55*c* disposed inward from the upper-side guide surface 55*a*. Subsequently, as shown in FIG. 20A, the motion acting portion 43 of each urging device 42, mounted to the process unit 2, contacts the rising slope surface of the guide device 55, and each of guiding members 56 (only one of the guiding members 56 is shown in the drawings), protruding laterally from lower portions of the right and left sides of the process unit 2 fits into the lower-side guide surface 55*b*, so that the process unit 2 is prevented from moving upward relative to the body housing 1, and is allowed only to be moved further inward along the lower-side guide surface 55*b*.

Figure 20A:
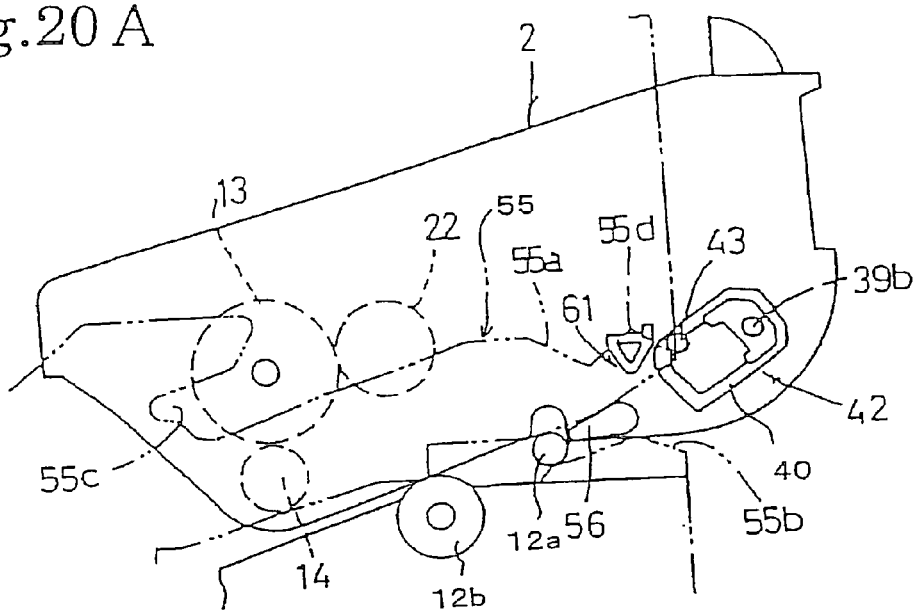
FIG. 20(*a*) illustrates a situation in which the process unit is being inserted into the body housing.

At this time, the register roller 12*a* moves downwardly due to its own weight as shown in FIG. 20A, and approaches the register roller 12*b* while slidingly contacting with the lower-side guide surface 55*b*.

Figure 20B:
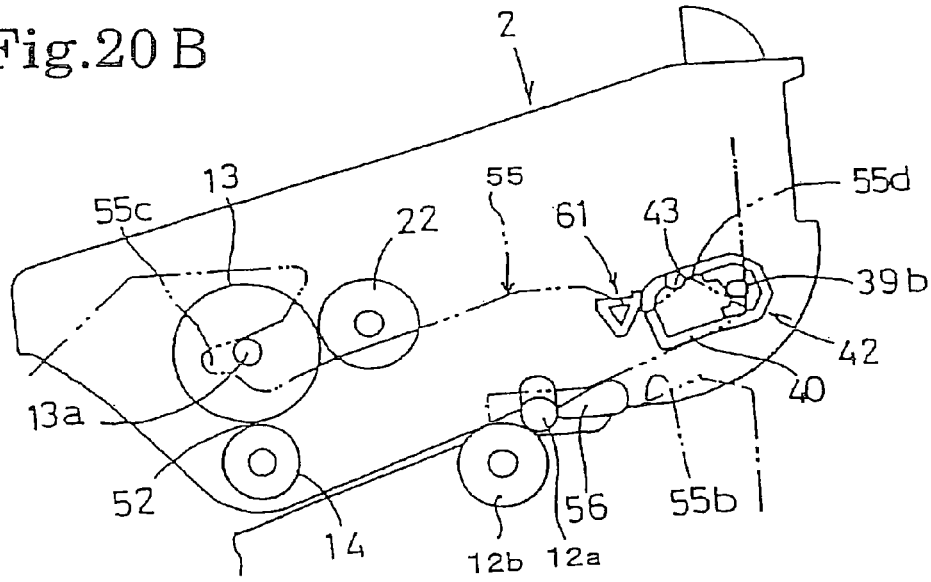

When the process unit 2 is thus pushed inward, the motion acting portion 43 of each urging device 42 is raised by the corresponding upper-side guide surface 55*a*, so that the slide support member 40 of each urging device 42 pivots upward about the pivots 39*a*, 39*b*. Therefore, the slide support member 40 of each urging device 42 restrains the corresponding one of the action-receiving portions 61 in such a direction that a distal end portion of the slide support member 40 pushes the action-receiving portion 61, as shown in FIG. 20B. When the motion acting portion 43 of each urging device 42 comes to the summit 55*d* of the rising slope surface, the slide support member 40 of each urging device 42 is pivoted to a most upward orientation. In this orientation, the distal end portion of the slide support member 40 of each urging device 42 keeps restraining the corresponding action-receiving portion 61.

At this time, the register roller 12*a* contacts the register roller 12*b*. The register rollers 12*a*, 12*b* move together while contacting each other as the process unit 2 is pushed further inward.

Figure 31:
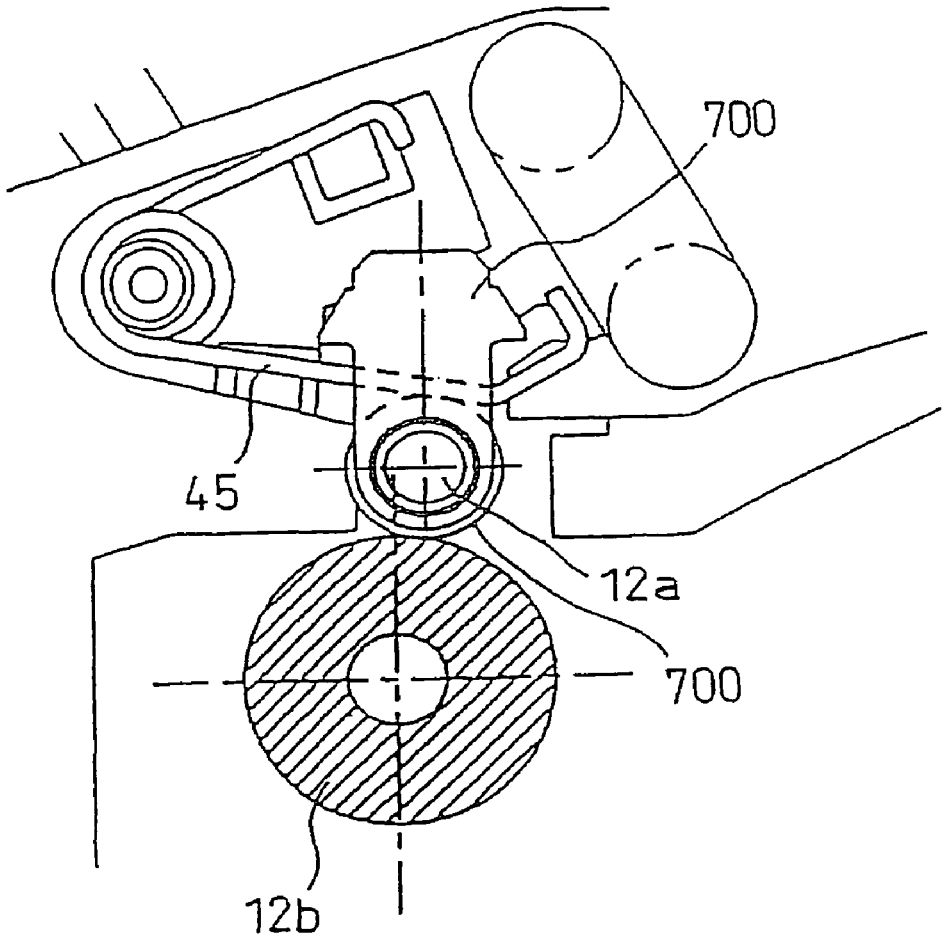
FIG. 31 is a view showing the register rollers 12*a*, 12*b*, bearing 700 and spring 45.

As the process unit 2 is pushed further inward, the shaft 13*a* of the photosensitive drum 13 is set to a predetermined position in the inward end portion 55*c*. At this position, an operator releases the process unit 2 from the operator's hands, so that the process unit 2 is set by its own weight into a state such that the register roller 12*a* is placed on the register roller 12*b*, as shown in FIG. 21. The bearings 700, 710 fitted at each end of the register roller 12*a* are pressed by springs 45, as shown in FIG. 31. Consequently, the register roller 12*a* presses against the register roller 12*b* at the appropriate position, angle, and pressing pressure.

When the process unit 2 is set into the body housing 1, as shown in FIG. 21, the distal end of the slide support member 40 of each urging device 42 presses the corresponding action-receiving portion 61. Therefore, the developing roller 22 is pressed against the photosensitive drum 13 by the urging devices 42 and the action-receiving portions 61.

Figure 9:
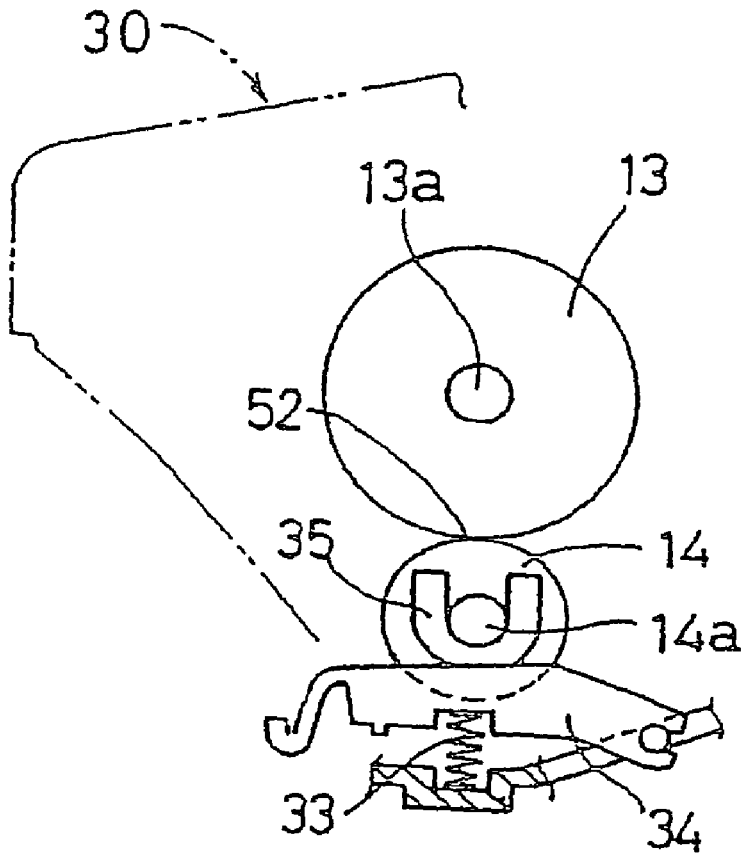
FIG. 9 is a sectional view taken on plane IX-IX in FIG. 8.

In the state such as shown in FIG. 21, and as further shown in FIG. 9, the bearings 35, vertically movably supporting the shaft 14*a* of the transfer roller 14, are raised by the shaft bearing raisers 34 that are urged by springs 33, so that the transfer roller 14 is moved upward to press the photosensitive drum 13 at a predetermined pressure.

As described above, as the process unit 2 is removed from the body housing 1, the register roller 12*a* is not fixed and instead freely moves up and down. The register roller 12*a* is positioned so as to press against the register roller 12*b* at the appropriate position, angle, and pressure only after the process unit 2 is set in the body housing 1. The accuracy of the position, angle, and pressing pressure of the register roller 12*a* with respect to the register roller 12*b* is determined by the springs 45 disposed on the body housing 1. Therefore, even when the process unit 2 is replaced, the relationship between the register rollers 12*a*, 12*b* can be appropriately maintained. Consequently, the sheet P can be constantly and stably conveyed.

The positioning of the register rollers 12*a*, 12*b* is performed with respect to the bearings 700, 710. The bearings 700, 710 are fitted to the register roller 12*a* so as to be spaced from each other at a distance that is longer than the width of the process unit 2, and are provided so as to extend outwardly from the side surface of the process unit 2. Therefore, the positioning of the register roller 12*a* is performed at each side surface of the body housing 1. When the process unit 2 is attached to or detached from the body housing 1 from the front face thereof, the springs 45 for positioning the register roller 12*a* are unlikely to interface with the path of the process unit 2 during the setting or removal thereof, so that the process unit 2 can easily be set into, and removed from, the body housing 1.

The register roller 12*a* is a shaft made of metal. While the rigidity of the register roller 12*a* is adequately maintained, the upper register roller 12*a*, which is longer than the width of the sheet P, is mounted to the process unit 2 via a simple structure. Therefore, cost reduction can be achieved.

As shown in FIG. 1, a sheet guiding opening 80, to guide the sheet P to the contact portion between the photosensitive drum 13 and the transfer roller 14, is provided on the case 30 adjacent to the register roller 12*a*. With the sheet guiding opening 80, the sheet P is smoothly conveyed to the contact portion between the photosensitive drum 13 and the transfer roller 14.

It is to be understood that the invention is not restricted to the particular forms shown in the foregoing embodiment. Various modifications and alternations can be made thereto without departing from the scope of the invention.

What is claimed is:

1. A photosensitive member cartridge for use with an image-forming apparatus, comprising:

a photosensitive drum;

a cartridge case comprising an upper wall, a bottom wall, a right side wall, and a left side wall, an outer surface of the upper wall facing upwards when the photosensitive member cartridge is installed in the image-forming apparatus, the right side wall extending upwardly from a right side of the bottom wall, the left side wall extending upwardly from a left side of the bottom wall, the upper wall connecting upper edges of the right side wall and the left side wall;

a light-entrance portion formed in the upper wall that is configured to allow a laser beam to pass through the upper wall and reach the photosensitive drum when the photosensitive member cartridge is installed in the image-forming apparatus; and an upwardly open accommodating portion for accommodating a developer cartridge that includes a developer roller, the accommodating portion being disposed adjacent to the light-entrance portion.

2. The photosensitive member cartridge of claim 1, wherein the light-entrance portion has a rectilinear shape.

3. The photosensitive member cartridge of claim 2, wherein the light-entrance portion has a rectangular shape.

4. The photosensitive member cartridge of claim 1, wherein the light-entrance portion is window shaped.

5. The photosensitive member cartridge of claim 1, wherein the photosensitive drum is rotatably journaled in the right side wall and the left side wall.

6. The photosensitive member cartridge of claim 1, wherein the light-entrance portion is elongated in an axial direction of the photosensitive drum.

7. The photosensitive member cartridge of claim 1, wherein the light-entrance portion is configured to allow the laser beam to irradiate an upper peripheral surface portion of the photosensitive drum.

8. The photosensitive member cartridge of claim 1, further comprising:

a charger that charges a surface of the photosensitive drum, the charger being disposed adjacent to the light-entrance portion.

9. The photosensitive member cartridge of claim 8, wherein the charger is a scorotron.

10. The photosensitive member cartridge of claim 8, wherein the light-entrance portion comprises a downwardly projecting wall that separates the light-entrance portion from the charger.

11. The photosensitive member cartridge of claim 10, wherein the downwardly projecting wall extends substantially an entire axial length of the photosensitive drum.

12. The photosensitive member cartridge of claim 10, wherein the downwardly projecting wall is connected to an inside surface of the upper wall of the cartridge case.

13. The photosensitive member cartridge of claim 1, wherein the light-entrance portion extends for substantially an entire axial length of the photosensitive drum.

14. The photosensitive member cartridge of claim 1, wherein the light-entrance portion comprises a downwardly projecting wall that separates the light-entrance portion from the accommodating portion.

15. The photosensitive member cartridge of claim 14, wherein the downwardly projecting wall extends substantially an entire axial length of the photosensitive drum.

16. The photosensitive member cartridge of claim 14, wherein the downwardly projecting wall is connected to an inside surface of the upper wall of the cartridge case.

17. A process unit, comprising:

the photosensitive member cartridge of claim 1; and the developer cartridge, the developer cartridge being detachably accommodated within the accommodating portion of the photosensitive member cartridge.

18. A photosensitive member cartridge for use with an image-forming apparatus, comprising:

a cartridge case comprising an upper wall, an outer surface of the upper wall facing upwards when the photosensitive member cartridge is installed in the image-forming apparatus;

a photosensitive drum having an upper peripheral surface portion that faces an inner surface of the upper wall;

a light-entrance portion formed in the upper wall that is configured to allow a laser beam to pass through the upper wall and irradiate the upper peripheral surface portion of the photosensitive drum when the photosensitive member cartridge is installed in the image-forming apparatus; and an upwardly open accommodating portion for accommodating a developer cartridge that includes a developer roller, the accommodating portion being disposed adjacent to the light-entrance portion.

19. A photosensitive member cartridge for use with an image-forming apparatus, comprising:

a photosensitive drum;

a cartridge case comprising an upper wall, the upper wall being located above the photosensitive drum when the photosensitive member cartridge is installed in the image-forming apparatus, and an outer surface of the upper wall facing upwards when the photosensitive member cartridge is installed in the image-forming apparatus;

a light-entrance portion formed in the upper wall that is configured to allow a laser beam to pass through the upper wall and reach the photosensitive drum when the photosensitive member cartridge is installed in the image-forming apparatus; and an upwardly open accommodating portion configured to accommodate a developer cartridge therein, the developer cartridge including a developer roller, and the accommodating portion being disposed adjacent to the light-entrance portion.

20. A photosensitive member cartridge for use with an image-forming apparatus, comprising:

a photosensitive drum;

a cartridge case comprising an upper wall and a bottom wall, an outer surface of the upper wall facing upwards when the photosensitive member cartridge is installed in the image-forming apparatus and an outer surface of the bottom wall facing downwards when the photosensitive member cartridge is installed in the image-forming apparatus; and a light-entrance portion formed in the upper wall that is configured to allow a laser beam to pass through the upper wall and reach the photosensitive drum when the photosensitive member cartridge is installed in the image-forming apparatus;

wherein at least a portion of the bottom wall defines an upwardly open accommodating portion configured to accommodate a developer cartridge therein, the accommodating portion being disposed adjacent to the light-entrance portion.

21. A photosensitive member cartridge for use with an image-forming apparatus, comprising:

a photosensitive drum;

a cartridge case comprising an upper wall, a bottom wall, a right side wall, and a left side wall, an outer surface of the upper wall facing upwards when the photosensitive member cartridge is installed in the image-forming apparatus, the right side wall extending upwardly from a right side of the bottom wall, the left side wall extending upwardly from a left side of the bottom wall, the upper wall connecting upper edges of the right side wall and the left side wall; and a light-entrance portion formed in the upper wall that is configured to allow a laser beam to pass through the upper wall and reach the photosensitive drum when the photosensitive member cartridge is installed in the image-forming apparatus; and an upwardly open accommodating portion for accommodating a developer cartridge, the accommodating portion being disposed adjacent to the light-entrance portion;

wherein the light-entrance portion comprises a downwardly projecting wall that separates the light-entrance portion from the accommodating portion.

* * * * *